US009297096B2

(12) United States Patent
Debaes et al.

(10) Patent No.: US 9,297,096 B2
(45) Date of Patent: Mar. 29, 2016

(54) METHOD OF WEAVING OF A PILE FABRIC WITH PILE-FREE ZONES

(71) Applicant: NV MICHEL VAN DE WIELE, Kortrijk/Marke (BE)

(72) Inventors: Johny Debaes, Moorslede (BE); Gilbert Moulin, Rekkem (BE); Dominique Maes, Dentergem (BE)

(73) Assignee: NV MICHEL VAN DE WIELE, Kortriji/Marke (BE)

( * ) Notice: Subject to any disclaimer, the term of this patent is extended or adjusted under 35 U.S.C. 154(b) by 0 days.

(21) Appl. No.: 14/368,296

(22) PCT Filed: Dec. 21, 2012

(86) PCT No.: PCT/IB2012/002785

§ 371 (c)(1),
(2) Date: Jun. 23, 2014

(87) PCT Pub. No.: WO2013/093611

PCT Pub. Date: Jun. 27, 2013

(65) Prior Publication Data

US 2015/0203998 A1 Jul. 23, 2015

(30) Foreign Application Priority Data

Dec. 23, 2011 (BE) ..... 2011/0762

(51) Int. Cl.

| | |
|---|---|
| ***D03D 27/10*** | (2006.01) |
| ***D03D 27/06*** | (2006.01) |
| ***D03D 15/00*** | (2006.01) |
| *D03D 27/00* | (2006.01) |

(52) U.S. Cl.

CPC ..... *D03D 27/06* (2013.01); *D03D 15/0033* (2013.01); *D03D 27/10* (2013.01)

(58) Field of Classification Search

CPC ..... D03D 27/10; D03D 39/16; D03D 27/06; D03D 39/00

See application file for complete search history.

(56) References Cited

U.S. PATENT DOCUMENTS 5,398,730 A * 3/1995 Derudder et al. ..... 139/21
5,465,761 A * 11/1995 Gheysen ..... 139/21

(Continued)

FOREIGN PATENT DOCUMENTS

| | | |
|---|---|---|
| DE | 19924214 A1 | 12/1999 |
| EP | 1130144 A1 | 9/2001 |
| NL | 9200219 A | 9/1992 |

OTHER PUBLICATIONS

International Search Report dated Feb. 20, 2014.

*Primary Examiner* — Bobby Muromoto, Jr.

(74) *Attorney, Agent, or Firm* — Symbus Law Group, LLC; Clifford D. Hyra

(57) ABSTRACT

A method for weaving pile fabrics with pile-free zones, in which, on a weaving loom, in successive series of at least two successive weft insertion cycles in each case at least one ground weft thread (1) and at least two effect weft threads (2),(3) having mutually different appearance-determining properties are inserted at well-defined weft-insertion levels, in which the effect weft threads (2),(3) in each series are inserted in successive weft insertion cycles, and in which, in order to create a predetermined effect in at least one pile-free zone, the warp threads (4-7);(12-22);(101-104) are positioned with respect to the weft insertion levels such that at least one effect weft thread (2),(3) runs on the pile side substantially uncovered.

30 Claims, 10 Drawing Sheets

(56) References Cited

U.S. PATENT DOCUMENTS

| | | | | |
|---|---|---|---|---|
| 6,457,490 | B2 * | 10/2002 | Dewispelaere et al. | 139/391 |
| 6,945,280 | B2 * | 9/2005 | Debaes | 139/21 |
| 7,117,897 | B2 * | 10/2006 | Debaes | 139/21 |
| 7,395,839 | B2 * | 7/2008 | Debaes | 139/21 |
| 7,520,303 | B2 * | 4/2009 | Mertens et al. | 139/21 |
| 7,621,297 | B2 * | 11/2009 | Debaes | 139/21 |
| 2001/0017168 | A1 * | 8/2001 | Dewispelaere et al. | 139/401 |
| 2004/0084101 | A1 * | 5/2004 | Debaes | 139/2 |
| 2004/0221910 | A1 * | 11/2004 | Debaes | 139/11 |
| 2007/0006932 | A1 * | 1/2007 | Mertens et al. | 139/37 |
| 2007/0125440 | A1 * | 6/2007 | Debaes | 139/383 R |
| 2008/0053557 | A1 * | 3/2008 | Debaes | 139/404 |

* cited by examiner

METHOD OF WEAVING OF A PILE FABRIC WITH PILE-FREE ZONES

This application claims the benefit of Belgian patent applications Nos. BE-2011/0762, filed Dec. 23, 2011, which is hereby incorporated by reference in its entirety.

FIELD OF THE INVENTION

The present invention relates to a method for weaving a pile fabric with one or more pile-free zones, in which in each case one or more ground weft threads are inserted between binding warp threads, tension warp threads and pile warp threads on a weaving loom in series of successive weft insertion cycles, so that at least one ground fabric is woven comprising ground weft threads, binding warp threads and tension warp threads, and so that pile warp threads are interlaced, in at least one pile zone, with one or more ground weft threads in the ground fabric while forming pile.

BACKGROUND

The term 'pile fabric' is used in the present patent application to refer to a fabric which, in at least one zone, has a fabric structure which renders the fabric thicker locally, such as for example by the presence of erect pile thread ends (cut pile), pile loops or ribs (as is the case, inter alia, with 'false bouclé fabrics') or a combination of two or more of these fabric structures.

Belgian patent publication BE 1 013 299 discloses a method for weaving a looped pile fabric with pile-free zones, in which the effect of a low-pile velvet can only be created in a pile-free zone by locally binding in effect weft threads with laterally protruding filaments.

Belgian patent publication BE 1 018 849 discloses a method for weaving fabrics with zones having a rib structure. The weft threads which support the ribs are inserted outside the ground fabric. By inserting first and second supporting weft threads with different colours, it is possible to use the one weft thread in the zones with a rib structure for rib formation, whereas the other weft thread runs visibly above the warp threads and creates an additional effect in these zones with a rib structure. Therefore, no effects are created here in the rib-free (i.e. pile-free) zones of the fabric.

The method according to the patent publication DE 19924214 makes it possible to achieve colour effects using different weft threads in pile-free zones of a pile fabric with cut pile. However, this method requires a special jacquard device which drives both the pile warp threads and the ground warp threads. This requires a considerable investment and renders the method used and the ground fabric relatively complicated.

SUMMARY

It is an object of the present invention to provide a simple method for weaving a pile fabric with pile-free zones which can be applied while requiring limited investments and offers a great degree of freedom of design for determining effects in pile-free zones, and in which these effects can, in addition, be varied in a highly flexible way.

The above objects are achieved by providing a method for weaving a pile fabric with one or more pile-free zones having the features described in the first paragraph of this description:

in which in each case at least one ground weft thread and at least two effect weft threads having mutually different appearance-determining properties are inserted at well-defined weft insertion levels in successive series of at least two successive weft insertion cycles, in which the effect weft threads of each series are inserted in successive weft insertion cycles, and in which, in order to create a predetermined effect in at least one pile-free zone, the binding warp threads and/or the pile warp threads are positioned in such a way with respect to the weft-insertion levels that, in at least one series, at least one effect weft thread runs substantially uncovered on the pile side of the ground fabric in at least a part of the pile-free zone.

For the sake of clarity, it is pointed out that the word 'series' in the present patent application is used first and foremost to refer to a series of successive weft insertion cycles, but that it is also used to refer to 'a series of weft threads', meaning the weft threads which are inserted during a series of successive weft insertion cycles.

The expressions 'substantially covered' and 'substantially uncovered' used in the present patent application refer to a cover which renders the effect weft threads invisible over more than half or less than half of their length, respectively, on the pile side in a specific zone or part-zone of the fabric.

As the method according to the present invention makes it possible to leave the features of one or more effect weft threads optionally substantially uncovered or substantially covered on the pile side of the ground fabric, creates an additional possibility to insert some variety in the pile-free zones of a pile fabric. Thus, each series of weft threads may comprise two or more effect weft threads of different colours and one or more of these colours in the pile-free zone can be made visible over part of or the complete pile-free zone in order to render a predetermined colour effect visible in said pile-free zone.

The method can be carried out by suitably positioning the pile warp threads. It is possible but not necessary to drive the binding warp threads, so that the method can be implemented with simple means.

During the successive series of weft insertion cycles, in each case a first and a second effect weft thread, having a first and a second appearance-determining property, are preferably inserted.

Even if more than two different effect weft threads are inserted per series, a first, second, third, fourth, . . . weft thread respectively having a first, second, third, fourth . . . appearance-determining property is preferably inserted in successive weft insertion cycles in each case.

The mutually different effect weft threads in each series are preferably also inserted in successive weft insertion cycles in the same order. Thus, the same positioning of warp threads always results in the same effect.

According to a highly preferred method, the effect is created by positioning the binding warp threads and/or the pile warp threads in such a way that, over several series, the one or more effect weft threads having the same appearance-determining properties run substantially uncovered on the pile side of the ground fabric in each case. A continually recurring positioning of warp threads with respect to the weft threads of several series then produces a well-defined effect on a surface of the pile-free zone.

In a particularly preferred method according to the present invention, the binding warp threads and/or the pile warp threads are positioned in such a manner that at least one effect weft thread of at least one series runs substantially uncovered on the pile side of the fabric in at least a part of the pile-free zone, while every other effect weft thread of this/these series in said part of the pile-free zone is substantially covered by binding warp threads and/or pile warp threads of the ground fabric. By substantially covering the effect weft threads which do not have to contribute to the effect in the pile-free zone at a certain location, the appearance-determining properties of the substantially uncovered effect weft threads are emphasized even more.

According to an advantageous method, the binding warp threads and/or the pile warp threads are positioned such that, in at least one series, a first effect weft thread runs substantially uncovered on the pile side of the ground fabric in a first part of a pile-free zone, and a second effect weft thread runs substantially uncovered on the pile side of the ground fabric in a second part of the same pile-free zone, so that a different effect is created in two parts of the same pile-free zone which succeed one another in the weft direction. Thus, it is possible to give the same pile-free zone a varied appearance.

According to another possibility of varying the appearance of a pile fabric, optionally in combination with the variation within the same pile-free zone described in the above paragraph, the binding warp threads and/or the pile warp threads are positioned such that, in at least one series, a first effect weft thread runs substantially uncovered on the pile side of the ground fabric in a first pile-free zone, and the second effect weft thread runs substantially uncovered on the pile side of the ground fabric in a second pile-free zone, so that a different effect is created in two pile-free zones which succeed one another in the weft direction and are separated from each other.

According to another preferred method, the pile warp threads in a pile-free zone are positioned such that at least one effect weft thread of at least one series runs substantially uncovered by pile warp threads on the pile side of the ground fabric, while every other effect weft thread of said series in said part of the pile-free zone is substantially covered by one or more pile warp threads of the ground fabric. The pile warp threads are usually thicker than the binding warp threads and consequently provide better coverage of the effect weft threads. In addition, the appearance-determining properties of the covering pile warp threads may also contribute to a greater variation in the appearance of the pile-free zones.

Preferably, pile warp threads in a pile-free zone are positioned such that one or more pile warp threads are not used for covering one or more effect weft threads and are bound in as dead pile warp threads in the ground fabric. These dead pile warp threads are preferably bound in the ground fabric together with the tension warp threads.

It is also possible to use the binding warp threads to cover the effect weft threads. In order to be able to achieve a sufficient degree of coverage, it may be necessary to use binding warp threads of a greater thickness than usual for this purpose. The binding warp threads are then positioned in a pile-free zone such that at least one effect weft thread of at least one series runs substantially uncovered by binding warp threads on the pile side of the ground fabric, while every other effect weft thread of this/these series in said part of the pile-free zone is substantially covered by one or more binding warp threads of the ground fabric.

In a particularly preferred method according to the present invention, on a weaving loom having at least three different weft-insertion levels, it is possible to insert, in successive weft insertion cycles, in each case an upper effect weft thread at an upper insertion level, and/or a lower effect weft thread at a lower insertion level, and a ground weft thread at an intermediate insertion level, between warp threads which are positioned with respect to the insertion levels in such a way that:

the upper effect weft threads in each case form part of the upper fabric, the lower effect weft threads in each case form part of the lower fabric, and the ground weft threads alternately form part of the upper and the lower fabric, in the upper fabric, at least one upper effect weft thread runs substantially uncovered for a predetermined length on the upper side of the fabric, so that a figurative side with a predetermined effect is produced on the upper side of said fabric, and in the lower fabric, at least one lower effect weft thread runs substantially uncovered for a predetermined length on the lower side of the fabric, so that a figurative side with a predetermined effect is produced on the lower side of said fabric.

By inserting a respective weft thread at three insertion levels in each insertion cycle, it is possible to insert a respective effect weft thread for each fabric per insertion cycle, as well as a third weft thread which is inserted alternately in the one and the other fabric as a ground weft thread. The ground weft threads are provided to be bound in a substantially invisible manner from the figurative side on the back of the fabrics, while the effect weft threads are provided in order to run substantially uncovered on the figurative side of a fabric for a predetermined length at certain locations, in accordance with the desired effect.

The present method according to the present invention makes it possible to provide the properties of one or more effect weft threads as desired, optionally substantially uncovered on the figurative side of the fabric. As a result thereof, it is additionally possible to provide variation in this figurative side.

Covering effect weft threads is achieved, for example, by suitably positioning certain warp threads.

These effect weft threads and ground weft threads may be identical. In many cases, however, a different type of weft yarn will be used for the ground weft threads than for the effect weft threads. Thus, the ground weft threads will often be jute threads or weft threads which make the properties of the back of the fabric suitable for a certain substrate.

At each insertion level, the weaving loom comprises a device for inserting weft threads (e.g. a gripper system), referred to as insertion device below. Each insertion device on the one hand comprises the insertion means itself (e.g. the grippers) and on the other hand, inter alia, also respective drive and guide means, braking means for reducing the speed of the weft threads, cutting means for cutting the yarn, and various other parts. All elements of such an insertion device have to be well designed and adjusted in accordance with the properties of the type of weft yarn which has to be inserted thereby. If two or more different types of weft yarn have to be inserted at a certain insertion level, then all elements of the insertion device provided at that insertion level have to be designed and adjusted to be able to cooperate as well as possible with the two or more different types of weft yarn. This is not easy and often results in the insertion devices operating in a less than satisfactory manner.

Due to the fact that with the weaving method according to the present invention the ground weft threads are always inserted at the intermediate insertion level, whereas the effect weft threads are always inserted at the upper and the lower insertion level, each insertion device of the weaving loom only has to be designed to insert one type of weft yarn. This avoids complicated and time-consuming adjustments and increases the operational reliability of the weaving loom.

In addition, if effect weft threads having different appearance-determining properties are to be introduced in the fabrics, a weft selection device is only required for the upper and the lower insertion means. The ground weave may also be very simple, so that driving of the ground warp threads can be achieved by simple means. The ground warp threads may, for example, be driven by heddles which are situated on a limited number of different weaving frames, for example 6 to 12 weaving frames, and driven by means of a cam drum, an electronic dobby or by means of servomotors and associated reduction gearboxes for each weaving frame.

Preferably, this method is used in such a way that, for each weft insertion level, in each case a yarn of virtually the same thickness is inserted during the successive insertion cycles. Preferably, this is a yarn with identical yarn number.

With the method according to the present invention, effect warp threads are preferably provided on the weaving loom, and these are then positioned such that, in at least one of the fabrics, one or more of said effect warp threads run on the figurative side of one or more effect weft threads and locally cover said effect weft threads, depending on the effect to be created.

Suitable positioning of these effect warp threads can be carried out using a jacquard machine. This may, for example, be a full three-position jacquard machine, in which each of the three positions (above, in between and below the weft insertion means associated with a fabric) in each weaving cycle can be achieved. The method can also be carried out with a jacquard machine in which only two of the three positions can be reached in each weaving cycle. Obviously, this then limits the design options.

Effect warp threads having such a 'covering function' can then be bound in the fabrics in such a manner that they themselves only contribute to a limited degree to the appearance of the figurative side of these fabrics, if at all.

Nevertheless, effect warp threads may also be provided in order to contribute to the appearance of the figurative side and thus have an 'appearance-determining function' in the fabric, in which case they are positioned in such a manner during the weaving that, in at least one of the fabrics, one or more of said effect warp threads alternately run on the figurative side of the fabric and are interlaced with one or more weft threads of the fabric, so that their appearance-determining properties contribute to creating the desired effect.

The same effect warp thread may have a covering function at a certain location in the fabric and have an appearance-determining function at another location in the fabric. Obviously, an effect warp thread may also cover the effect weft threads located underneath at the same location in the fabric and itself contribute to the appearance of the figurative side, and thus simultaneously serve both functions.

In this patent application, both the 'covering function' and the 'appearance-determining function' of the effect warp threads are considered to be 'effect-producing'. For even in the covering function, the effect warp threads contribute to producing the desired effect, namely by locally covering certain effect weft threads. A (part of an) effect warp thread which fulfils one of the two functions is thus 'effect-producing'. A (part of an) effect warp thread which fulfils none of the two functions or for which these covering and appearance-determining functions are of minor importance will be referred to below as 'non-effect-producing'.

The effect warp threads are preferably interlaced either with ground weft threads or with effect weft threads of the respective fabric.

With a number of known double-face weaving methods, warp threads which are to be bound in a ground fabric have to carry out two different movements in order to be correctly positioned in the successive insertion cycles. This renders adjustments on the weaving loom difficult and may adversely affect the operation of the weaving loom, thus lowering productivity.

With the method according to the present invention, the drawback mentioned in the previous paragraph is overcome if (parts of) effect warp threads running between the ground weft threads, on the one hand, and the effect weft threads, on the other hand, are bound in an extended state in the upper and/or the lower fabric, or running alternately above and below the successive ground weft threads are bound in in the upper and/or the lower fabric.

These parts are then preferably parts of non-effect-producing effect warp threads. With this method, it is sufficient, for example, always to position effect warp threads 'between the lower and the intermediate insertion level' during the successive insertion cycles in order to bind in these effect warp threads in a non-effect-producing manner in an extended state between the ground weft threads and the effect weft threads of the lower fabric.

According to this method, the abovementioned drawback can be solved equally well if (parts of) effect warp threads, running alternately above and below the successive effect weft threads, are bound in in the upper and/or the lower fabric. These (parts of) effect warp threads can then mainly have a covering function at that location in the fabric, with the desired effect being formed mainly by the effect weft threads running on the figurative side of these effect warp threads. Thus, it is sufficient, for example, to position effect warp threads alternately 'below the lower insertion level' and 'between the lower and the intermediate insertion level' during the successive insertion cycles in order to make them run alternately below and above the successive effect weft threads in the lower fabric.

By making effect warp threads run either in an extended state between effect weft threads and ground weft threads or alternately above and below the successive effect weft threads with the method according to the present invention, the effect warp threads can thus be held in the same position during the weaving or it suffices to carry out one single movement between two different positions in order to correctly position them in the successive insertion cycles with respect to the three different weft-insertion levels. Preparing the weaving loom for the weaving procedure becomes simpler if the warp threads have to carry out fewer different movements during weaving.

According to a particularly preferred method, a double-face weaving method is used in which two ground fabrics are woven one above the other, with one or more pile warp threads being interlaced alternately in the upper and the lower ground fabric with a ground weft thread and being cut between both ground fabrics, so that two pile fabrics are formed.

The pile warp threads can then be positioned such that one or more pile warp threads form pile according to a 1/n V pile weave, in which n equals the number of weft threads which is inserted in every ground fabric in each series. If three weft threads are provided for each series and for each ground fabric, a 1/3 V pile weave is obtained.

This method can be used on a weaving loom which is designed to insert a weft thread in each case at two weft-insertion levels in the successive weft insertion cycles. This may, for example, be a double-gripper weaving loom. The method is then applied, for example, in such a manner that each series comprises three weft insertion cycles, and that, during each series, a ground weft thread, a first effect weft thread with a first appearance-determining property, and a second effect weft thread with a second appearance-determining property are inserted at two different weft-insertion levels. More particularly, for each series of three weft insertion cycles, for example:

- in the first weft insertion cycle, in each case a first effect weft thread is inserted at one weft insertion level and a ground weft thread is inserted at the other weft insertion level,
- in the second weft insertion cycle, in each case a second effect weft thread is inserted at one weft insertion level, and a first effect weft thread is inserted at the other weft insertion level, and
- in the third weft insertion cycle, in each case a ground weft thread is inserted at one weft insertion level and a second effect weft thread is inserted at the other weft insertion level.

This requires a weft change motion which can offer three different weft yarns at two different levels.

In a method which uses a weaving loom with two weft-insertion levels, the pile warp threads can be positioned by means of a three-position jacquard device by means of which every position (above the upper weft insertion level, below the lower weft insertion level and between both weft-insertion levels) in every weft insertion cycle is attainable.

According to a very advantageous method, weft threads are inserted at at least three different weft-insertion levels. In this case, a weaving loom having three weft insertion levels is most preferred. Compared to the above-described method using a weaving loom having two weft-insertion levels, a higher production rate can be achieved, because the insertion of three weft threads per ground fabric can now take place in two weft insertion cycles instead of three weft insertion cycles. Another advantage is the fact that a simpler weft change motion can be used, as will be explained below.

This method makes it possible to provide two weft insertion cycles per series and to insert, per series at the upper level a ground weft thread and a first effect weft thread with a first appearance-determining property, to insert at the central level in each case a second effect weft thread with a second appearance-determining property, and at the lower level to insert a first effect weft thread and a ground weft thread.

This requires a weft change motion which can present two different weft yarns to the weft insertion means for the upper insertion level, and which can present two different weft yarns to the weft insertion means for the lower insertion level. The weft insertion means for the central level always insert the same weft yarn. This weft change motion, referred to as 2×2, is simpler than the weft change motion for inserting three weft yarns at two levels, referred to as 2×3, which is used with a weaving loom having two weft-insertion levels.

In this case, the pile warp threads are positioned such that one or more pile warp threads form pile according to a 2/n V pile weave, in which n equals the number of weft threads which is inserted in each ground fabric for each series. If 3 weft threads are provided per series and per ground fabric, a 2/3 V pile weave is obtained.

With this method, use is preferably made of a four-position jacquard device for positioning the pile warp threads by means of which every position in every weft insertion cycle is attainable.

When weaving the above-described pile fabrics, the pile-forming pile warp threads are preferably bound through. In other words, they are interlaced in every ground fabric with one or more ground weft threads which run along the back of the pile fabric with respect to the tension warp threads of the respective ground fabric. Preferably, the warp threads on the weaving loom are distributed in such a way over a number of reed openings, in which only one binding warp thread is provided for each reed opening per ground fabric, and the binding warp threads are positioned such that several sets of two cooperating binding warp threads are taken alternately above and below at least one weft thread, running in counter-phase with respect to each other, with two cooperating binding warp threads of a set belonging to two adjacent reed openings, respectively.

As a result thereof, the effect weft threads can be bound in by a smaller number of binding warp threads. The one or more effect weft threads which, depending on the desired effect, run substantially uncovered on the pile side of the fabric, are consequently also covered by a smaller number of binding warp threads, which obviously further increases their visibility and thus the created effect.

The present method can also be used when weaving a pile fabric having at least one pile zone with pile loops, in which at least one ground fabric is woven while loop weft threads are kept at a distance from the ground fabric, while one or more pile warp threads are alternately interlaced with a ground weft thread in the ground fabric and run over at least one loop weft thread so that pile is formed.

It is also possible to weave looped pile fabrics with weft effects according to a double-face weaving method, in which two ground fabrics are woven one above the other while respective loop weft threads are kept at a distance from the ground fabrics, one or more first pile warp threads are alternately interlaced in the upper ground fabric and run over at least one loop weft thread, so that pile loops are formed on the upper ground fabric, and one or more second pile warp threads are alternately interlaced in the lower ground fabric and run over at least one loop weft thread, so that pile loops are formed on the lower ground fabric, respectively.

Even when weaving a pile fabric which comprises at least one zone with looped pile and at least one zone with cut pile, the method according to the present invention can be used. Such a fabric is woven, for example, according to a double-face weaving method, in which two ground fabrics are woven, one above the other, while respective loop weft threads are kept at a distance from the ground fabrics, for example by means of a lancet, in which one or more first pile warp threads are alternately interlaced in the upper ground fabric and run over at least one loop weft thread, so that pile loops are formed on the upper ground fabric, in which one or more second pile warp threads are alternately interlaced in the lower ground fabric and run over at least one loop weft thread, so that pile loops are formed on the lower ground fabric, and in which one or more third pile warp threads are alternately interlaced in the upper and the lower ground fabric with a ground weft thread and are cut between both ground fabrics, so that a zone of cut pile is produced on both ground fabrics.

The different effect weft threads may, for example, differ from each other by one or more of the following appearance-determining properties: colour, hairiness, lustre, coarseness, yarn material, thickness.

In the following description, some preferred methods of weaving a pile fabric containing one or more pile-free zones, according to the present invention, are described in detail. The sole aim thereof is to describe a number of possible applications of the method and by means thereof to illustrate, and, if necessary to explain, the particular features and advantages of this method and of the pile fabrics woven in this manner. This description can therefore by no means be seen as a limitation of the scope of protection of the present patent.

BRIEF DESCRIPTION OF THE DRAWINGS

In this description, reference is made to the attached FIGS. 1 to 6, each of which shows one or two diagrammatic cross sections along the warp direction of a part of a pile fabric having one or more pile-free zones which is woven according to the present invention, in which FIGS. 1, 2, 3 and 6 in each case show two diagrammatic cross sections, one above the other, which respectively show the warp threads which extend through an adjacent first and a second reed opening between reed dents of the weaving loom, and in which.

DETAILED DESCRIPTION OF EMBODIMENTS

The present invention can be used, inter alia, in the weaving of pile fabrics according to a double-face weaving method, in which use is made of a double-face weaving loom which is designed to insert, in successive weft insertion cycles, in each case at two different insertion levels, a respective weft thread in a weft direction between warp threads which are provided on the weaving loom and extend in the warp direction (i.e. at right angles to the weft direction).

Figure 1:
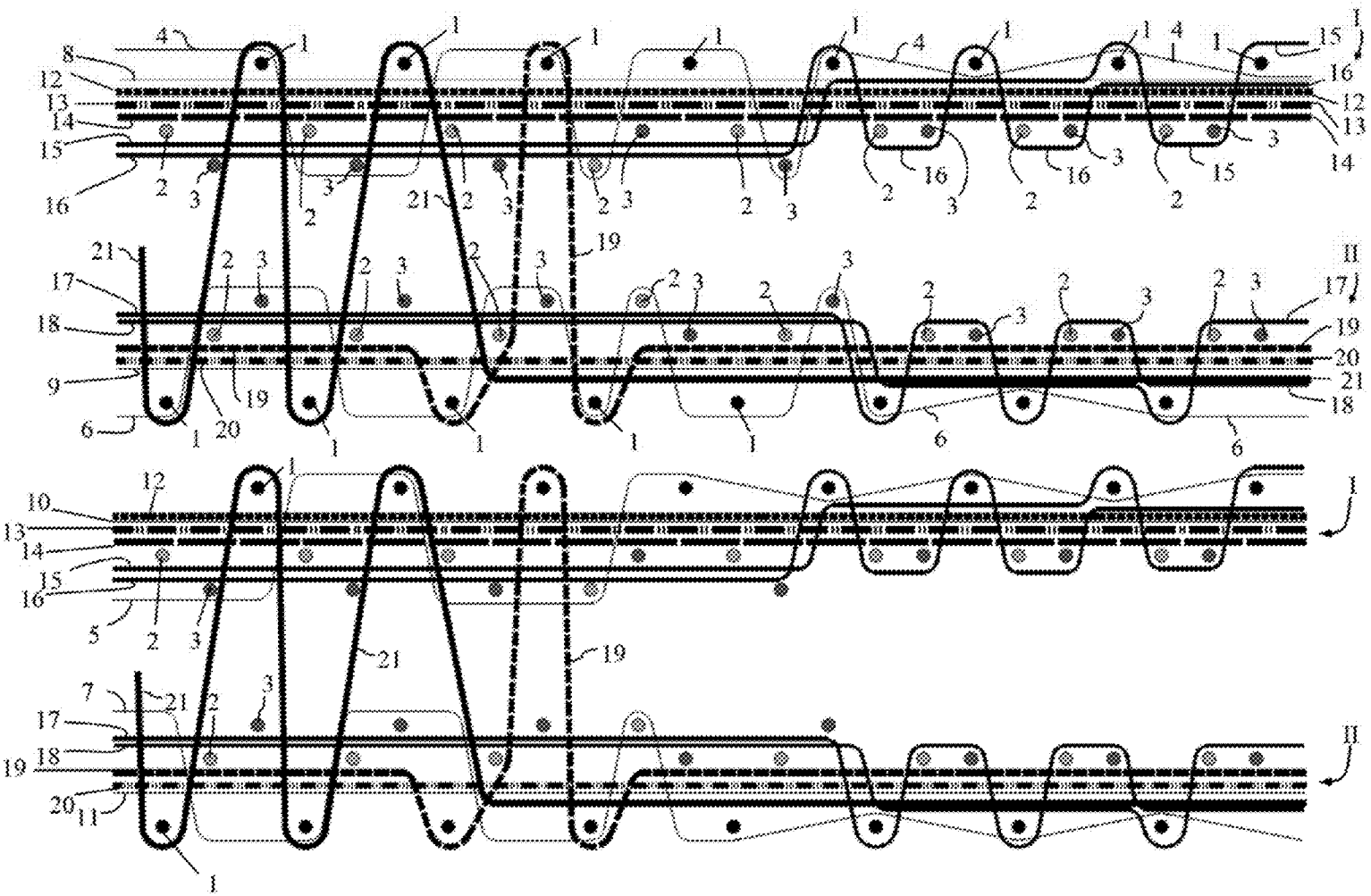
FIG. 1 shows two cross sections of a double-face pile fabric which is woven on a two-gripper weaving loom, in which pile warp threads form pile as they are interlaced alternately in the upper and the lower ground fabric.

The weaving loom is, for example, a two-gripper-weaving loom provided with two gripper systems for inserting weft threads at an upper and a lower insertion level, respectively. FIG. 1 shows two cross sections in the warp direction of a part of a double-face pile fabric woven on such a weaving loom.

As is known, a weaving loom comprises a reed with a plurality of reed dents with reed openings situated in between. In order to carry out the method according to FIG. 1, two binding warp threads (4),(6); (5),(7), two tension warp threads (8),(9); (10),(11) and ten differently coloured pile warp threads (12)-(21) extend through each reed opening in the warp direction. Alternatively, it is also possible for the pile warp threads covering the effect weft threads to be chosen to be identical, so that the same effect is produced in both fabrics in the zone where the weft effect is desired.

In the upper cross section of FIG. 1, the warp threads (4, 6),(8, 9),(12-21) of a first reed opening are shown, while the warp threads (5,7),(10,11),(12-21) of a second adjacent reed opening are illustrated in the lower cross section. The pile warp threads (12)-(21) in both reed openings have the same path with respect to the weft threads (1),(2),(3) and are denoted by the same reference numerals (12) to (21), despite being different warp threads. In FIG. 1, the non-pile-forming pile warp threads bind in in the same ground fabric in both reed openings. It is also possible for the non-pile-forming pile warp threads to alternately bind in the one and then the other ground fabric in successive reed dents.

In series of three successive weft insertion cycles, a weft thread is in each case inserted, both by the upper and the lower gripper system, at the upper and the lower weft insertion level, respectively. The weft threads which are inserted during the same weft insertion cycle have been illustrated vertically one above the other in the figures.

Both gripper systems insert a ground weft thread (1), a first effect weft thread (2) of a first colour, and a second effect weft thread (3) of a second colour in a continually repeating sequence and always in the same order. However, as can be seen in FIG. 1, the insertion of these three different weft threads at the upper and the lower weft insertion level does not occur simultaneously.

In each series of three weft insertion cycles, the following steps are carried out:

- in the first weft insertion cycle, in each case a first effect weft thread (2) is inserted at the upper weft insertion level and a ground weft thread (1) is inserted at the lower weft insertion level;
- in the second weft insertion cycle, in each case a second effect weft thread (3) is inserted at the upper weft insertion level and a first effect weft thread (2) is inserted at the lower weft insertion level; and
- in the third weft insertion cycle, in each case a ground weft thread (1) is inserted at the upper weft insertion level and a second effect weft thread (3) is inserted at the lower weft insertion level.

The first (2) and the second effect weft threads (3) are inserted in each ground fabric in successive weft insertion cycles and always in the same order.

During the successive weft insertion cycles of the weaving loom, the binding warp threads (4-7) and tension warp threads (8-11) are positioned in such a manner that an upper (I) and a lower ground fabric (II) are woven simultaneously, with both ground fabrics being situated one above the other at a distance apart.

The upper ground fabric (I) is formed by the weft threads (1),(2),(3) inserted at the upper weft insertion level being bound in by sets of two cooperating binding warp threads (4),(5) for the upper ground fabric (I). The lower ground fabric (II) is formed by the weft threads (1),(2),(3) inserted at the lower weft insertion level being bound in by sets of two cooperating binding warp threads (6),(7) for the lower ground fabric (II).

Tension warp threads (8),(10) extend in the upper ground fabric (I) and run in each case above the first (2) and the second effect weft threads (3) and below the ground weft threads (1). In the lower ground fabric (II), the tension warp threads (9),(11) in each case run below the first (2) and the second effect weft threads (3) and above the ground weft threads (1). In both ground fabrics (I),(II), the ground weft threads (1) are thus situated on the back of the tension warp threads (7),(8); (9),(10), while the first (2) and second effect weft threads (3) run on the pile side of these tension warp threads.

Here and in the remainder of the text, the pile side of the tension warp threads is intended to mean the side in the pile fabric with respect to the tension warp threads which is situated on the side of the figurative pile surface, the back is the other side which, for example in the case of carpeting, is turned towards the floor.

The pile side of a fabric is here therefore also the side of the figurative surface and the back is the other side which, for example in the case of carpeting, is turned towards the floor.

Two cooperating binding warp threads (4),(5); (6),(7) are not situated together in the same reed opening, but in adjacent reed openings. This can be seen, inter alia, in FIG. 1 (see also FIGS. 3 and 6), where the warp threads illustrated in the upper and the lower cross section comprise only one binding warp thread (4),(6) per ground fabric (I),(II). As a result thereof, the effect weft threads (2),(3) used to create a certain effect in pile-free zones will be interlaced to a lesser degree by binding warp threads, as a result of which they are more visible.

Each binding warp thread (4),(5);(6),(7) runs alternately above and below a number of weft threads (1),(2),(3). In this case, two cooperating binding warp threads (4),(5);(6),(7) run substantially in counterphase with respect to each other. This is understood to mean that, if one binding warp thread runs above a group of one or more weft threads, the other binding warp thread runs below this group of one or more weft threads, and vice versa. The cooperating binding warp threads cross each other in each case between two successive groups of weft threads. As a result thereof, the weft threads are bound in between these binding warp threads (4),(5);(6),(7).

In the left-hand part of the double-face fabric illustrated in FIG. 1, the cooperating binding warp threads (up to and including the weft threads of the fifth series) in each ground fabric (I),(II) have a path in counterphase in which the binding warp threads (4),(5);(6),(7) run alternately above and below a group of three successive weft threads. These three weft threads are, for example (but not necessarily), the three weft threads of a series.

In the right-hand part of the double-face fabric illustrated in FIG. 1, two cooperating binding warp threads (4),(5);(6),(7) run in counterphase, alternately above and below a ground weft thread (1) which extends on the back of the ground fabrics (I),(II).

In order to position the binding warp threads, a simple cam drive on weaving frames may suffice, for example executing a movement which, during three successive weft insertion cycles, alternately takes the binding warp threads for each ground fabric (I),(II) above the weft insertion level and, during three successive weft insertion cycles, below this weft insertion level. As has been explained above, sets of two cooperating binding warp threads are provided for each ground fabric which are in each case displaced in the opposite direction with respect to the weft insertion level. With such a drive, all binding warp threads along the width of the fabric are positioned in the same way. This is also the case if the binding warp threads are situated on weaving frames which are driven by an electronic dobby or by a separate drive for each weaving frame by means of a servomotor. In these cases, there is more freedom with regard to the pattern of movement which makes it possible, for example, to provide weft effects across the entire weaving width, i.e. stripe-like in the weft direction.

The method according to the present invention also provides for the binding warp threads to be used for covering effect weft threads (2),(3) in a pile-free zone. It is possible to purposely select, for example, relatively thick binding warp threads (4),(5);(6),(7) for this purpose. It is also possible to keep the binding warp threads in a certain pile-free zone substantially invisible locally, for example in order not to disturb the effect of pile warp threads which run over one or more weft threads on the pile side in a floating manner, as in the right-hand part of FIG. 1. In these cases, a weaving frame is no longer sufficient for positioning the binding warp threads. In those cases, a jacquard device by means of which the binding warp threads (4),(5);(6),(7) can be positioned individually offers the maximum degree of freedom to determine the effect by means of the binding warp threads as well. With the method from FIG. 1, a two-position jacquard device would suffice.

During the successive weft insertion cycles, the mainly differently coloured pile warp threads (12-21) of each reed opening are positioned in such a manner with respect to the upper and the lower weft insertion level that, per reed opening, pile is formed during the first, second and third series of three weft insertion cycles (in FIG. 1 starting from the left) due to a pile warp thread (19),(21) being interlaced alternately with a ground weft thread (1) of the lower ground fabric (II) and a ground weft thread (1) of the upper ground fabric (I).

During the first and the second series of weft insertion cycles, pile is formed by a first pile warp thread (21) of a certain colour, while, during the third series of weft insertion cycles, pile is formed by a second pile warp thread (19) of another colour. The pile-forming pile warp threads are in each case interlaced with a ground weft thread (1) which is situated on the back of the ground fabric.

The pile-forming first (19) and second pile warp threads (21) are subsequently cut between the two ground fabrics (I),(II), so that two separate pile fabrics are obtained on which the erect thread ends of the cut pile warp threads (17),(19) form pile.

Where the pile warp threads (12-21) do not form pile, they are positioned in such a way that they are either interlaced in the upper (I) or the lower ground fabric (II) as dead pile warp threads, or extend above one or more effect weft threads (2),(3) in order to substantially cover these. On the double-face fabric from FIG. 1, no pile is formed from the fourth series of three weft insertion cycles. The right-hand part of the double-face fabric illustrated in FIG. 1 thus forms part of a pile-free zone. In this pile-free zone, an additional effect is created by means of the coloured effect weft threads (2),(3), as will be explained below.

In the first to fifth series of three weft insertion cycles, two pile warp threads (15),(16); (17),(18) are positioned per ground fabric (I),(II) in such a way that they run along the pile side of the respective ground fabric (I),(II), that either the first effect weft threads (2) or the second effect weft threads (3) of these series are in each case situated between these pile warp threads (15),(16); (17),(18) and the respective ground fabric (I),(II) and are thus substantially covered by these pile warp threads (15),(16); (17),(18), and that the second effect weft threads (3) or the first weft threads (2) of these series, respectively, run in each case on the pile side of these pile warp threads (15),(16); (17),(18) and thus run substantially uncovered on the pile side of the ground fabrics.

In the sixth to eighth series of three weft insertion cycles, per ground fabric (I),(II) one of these two pile warp threads (15),(16);(17),(18) is interlaced in each case as dead pile warp thread together with the tension warp thread (8),(9);(10),(11) between, on the one hand, the ground weft threads (1) and, on the other hand, the effect weft threads (2),(3), while the other pile warp thread of the abovementioned pairs in each case alternately runs along the pile side of the two effect weft threads (2),(3) and is interlaced with a ground weft thread (1). As a result thereof, the two effect weft threads (2),(3) of these series are locally substantially covered by a pile warp thread (15),(16);(17),(18).

By purposely positioning the pile warp threads (12)-(21) per ground fabric (I),(II), a pile-free zone is produced (the fourth to eighth series of three weft threads):

having a first part (the fourth and the fifth series) in which either the first effect weft threads (2) or the second effect weft threads (3) run substantially uncovered by pile warp threads and binding warp threads on the pile side of the fabric, and the second effect weft threads (3) or the first effect weft threads (2), respectively, are substantially covered by pile warp threads (15),(16); (17),(18); and having a second part (the sixth to eighth series) in which the first (2) and the second effect weft threads (3) are substantially covered by pile warp threads (15),(16); (17).

In the fourth series of three weft threads, in the first part of the pile-free zone, only the relatively thin binding warp threads (4),(5);(6),(7) on the pile side run over the first effect weft threads (2), so that the colour of the substantially uncovered first effect weft threads (2) on the pile side is clearly visible here. The second effect weft threads (3) are substantially covered by the two thicker pile warp threads (15),(16); (17),(18), so that their colour will be substantially invisible here.

In the second part, both effect weft threads (2),(3) are substantially covered by a pile warp thread (15),(16);(17), so that their colours will not be clearly visible on the pile side. In this second part, the colour of the covering pile warp thread (15),(16);(17) will contribute to determining the appearance of the pile-free zone. In the sixth and the seventh series, one pile warp thread (16) in the upper ground fabric (I) will be used as covering pile warp thread, and in the eighth series the other pile warp thread (15) will be used, while the non-covering pile warp thread (15),(16) is in each case interlaced as dead pile warp thread. As a result thereof, the colour of the one pile warp thread and the colour of the other pile warp thread successively determine the appearance of the pile-free zone. Thus, an additional colour variation in the pile-free zone is obtained.

According to the method described above with reference to FIG. 1, a 1/3V pile fabric with pile-free zones ('chisel zones') is produced, in which an additional effect is achieved in a pile-free zone by means of two differently coloured effect weft threads (2),(3). For this purpose, three different types of weft yarn (two different effect weft yarns and one ground weft yarn) have to be presented to the weft insertion means of the weaving loom (e.g. the gripper systems operating on two levels) for each weft insertion level. This requires a weft change motion which can present in each case three different types of weft yarn at two different levels.

With this weave structure, pile is interlaced with one weft thread per series of three weft threads (1),(2),(3) in each ground fabric. It is possible to increase this number of weft threads over which pile is formed. If this is increased to four, series of four successive weft insertion cycles are obtained, in which in each case one ground weft thread (1) and three effect weft threads are inserted in the same order per ground fabric. The pile weave thus becomes a 1/4V pile weave. Each series of weft threads (1),(2),(3) contains one ground weft thread (1) which runs on the back of the fabric with respect to the tension warp threads (7),(8);(9),(10) and three effect weft threads (2),(3) which run on the pile side.

In general, an increase to n weft threads (1),(2),(3) per series and per ground fabric results in a 1/n V pile weave with one ground weft thread (1) on the back of the fabric and (n−1) effect weft threads (2),(3) on the pile side. The weft change motion therefore has to be adapted to the modified number of effect weft threads too and has to be designed for inserting n different weft threads (1),(2),(3) at two different weft-insertion levels.

In that case, a weave pattern is for example designed for the tension warp threads (9),(11) of the lower ground fabric (II) in which the tension warp thread runs alternately above one weft thread (1),(2),(3) and below (n−1) weft threads. The tension warp threads (8),(10) of the upper ground fabric (I) then run alternately above (n−1) weft threads (1),(2),(3) and below one weft thread. Up to a 1/8V pile weave, this can still be achieved with a cam drive via weaving frames. If n is equal to or greater than 9, i.e. from a 1/9V pile weave, a longer weave repeat has to be accommodated for by a dobby drive or a servodrive for the weaving frame, optionally even a jacquard drive for each heddle or each group of heddles.

The binding warp threads (4),(5);(6),(7) of both ground fabrics (I),(II) are, for example, taken alternately above n weft threads and below n weft threads (1),(2),(3) by means of a repetitive, less complicated drive, in which sets of two cooperating binding warp threads (4),(5);(6),(7) are provided which move in counterphase with respect to each other. Up to n=4, that is up to a 1/4V pile weave, this can still be achieved by means of a cam drive via weaving frames. If n is equal to or greater than 5, i.e. from a 1/5V pile weave, a longer weave repeat has to be accommodated for by a dobby drive or a servodrive for the weaving frame, optionally even a jacquard drive for each heddle or for each group of heddles.

In order to drive the pile warp threads (12-21), a universal three-position jacquard device is required. This means that each of the three possible positions, i.e. above the upper weft insertion level, between the upper and the lower weft insertion level, and below the lower weft insertion level has to be attainable in every weft insertion cycle.

Coverage within a certain zone can be effected by non-pile-forming pile warp threads (12)-(21) according to a 1/1 weave structure, a twill weave or a satin weave, for example a twill 4 or a satin 4, in accordance with the desired effect. This is possible as the pile warp threads have to be positioned by means of a universal three-position jacquard device.

The present invention can inter alia also be used when weaving pile fabrics according to a double-face weaving method, in which use is made of a double-face weaving loom which is designed to insert, in successive weft insertion cycles, in each case at three different insertion levels, a respective weft thread in a weft direction between warp threads (4-21) which are provided on the weaving loom and extend in the warp direction (i.e. at right angles to the weft direction).

Figure 2:
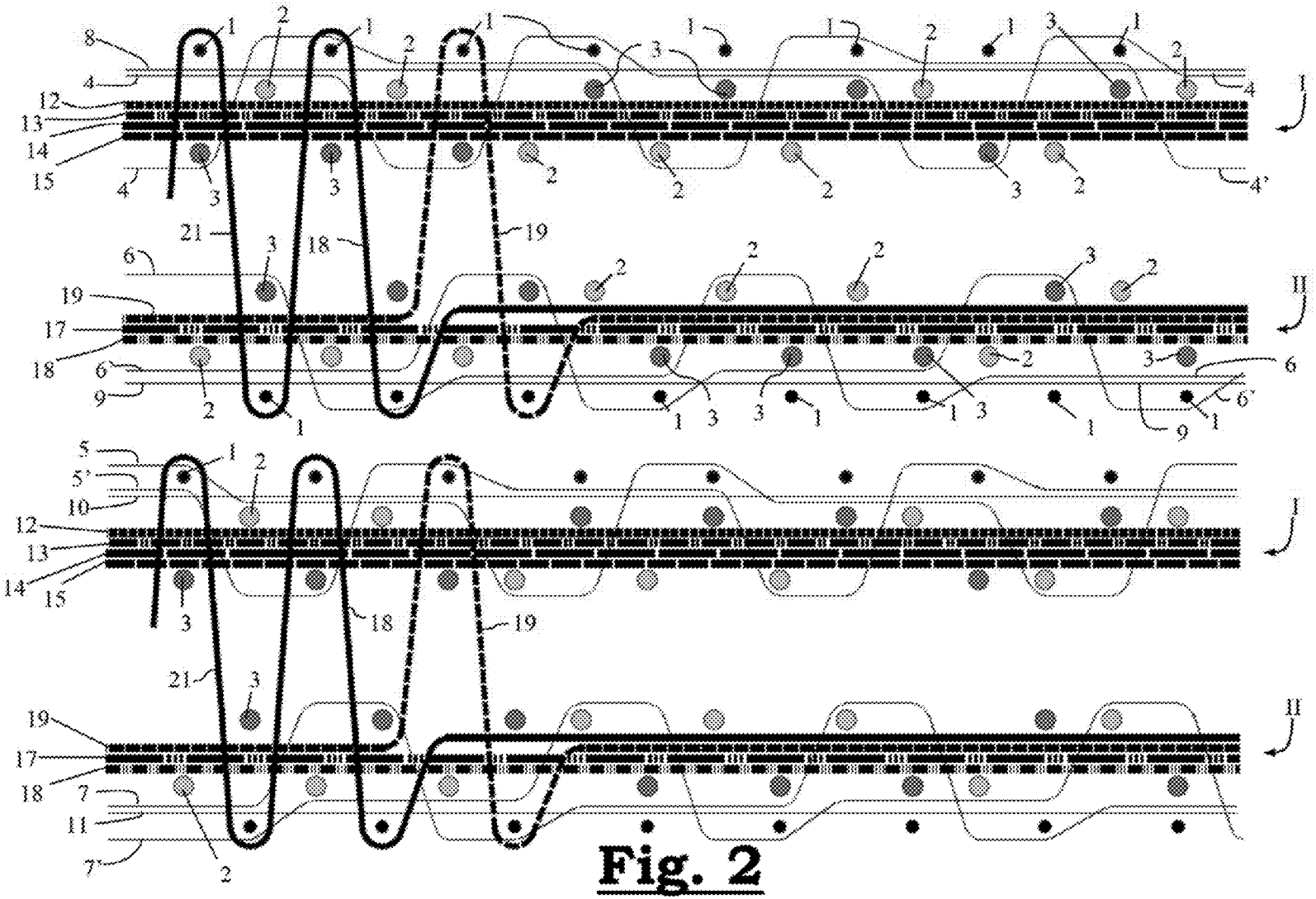
FIGS. 2, 3 and 4 each show two cross sections of a different double-face pile fabric which is woven on a three-gripper weaving loom, in which pile warp threads form pile as they are interlaced alternately in the upper and the lower ground fabric.

Such a method is illustrated in FIG. 2. The weaving loom used is, for example, a three-gripper weaving loom provided with three gripper systems for inserting weft threads (1),(2),(3) at an upper position, a central position and a lower position, respectively. FIG. 2 shows two cross sections in the warp direction of a part of a double-face pile fabric woven on such a weaving loom.

In order to carry out the method from FIG. 2, two binding warp threads (4),(6); (5),(7), two tension warp threads (8),(9); (10),(11) and eight differently coloured pile warp threads (12)-(15),(17)-(19),(21) extend through each reed opening in the warp direction. Alternatively, it is also possible to select the same pile warp threads in both ground fabrics to cover the effect weft threads so that the same effect is achieved in both fabrics in the zone where the weft effect is desired to be visible.

In series of two successive weft insertion cycles, the three gripper systems insert a ground weft thread (1) and two different effect weft threads (2),(3) for each ground fabric (I),(II).

In a continually repeating sequence and always in the same order, the upper gripper system inserts a ground weft thread (1) and a first effect weft thread (2) at the upper weft insertion level. The central gripper system inserts a second effect weft thread (3) at the central weft insertion level during each weft insertion cycle. In a continually repeating sequence and always in the same order, the lower gripper system inserts a first effect weft thread (2) and a ground weft thread (1) at the lower weft insertion level.

In each series of two successive weft insertion cycles:

insertion of the following takes place in each case during the first weft insertion cycle:

- a ground weft thread (1) for the upper ground fabric, at the upper weft insertion level,
- a second effect weft thread (3) for the upper ground fabric, at the central weft insertion level, and
- a first effect weft thread (2) for the lower ground fabric at the lower weft insertion level;

and insertion of the following takes place in each case in the second weft insertion cycle:

- a first effect weft thread (2) for the upper ground fabric, at the upper weft insertion level,
- a second effect weft thread (3) for the lower ground fabric, at the central weft insertion level, and
- a ground weft thread (1) for the lower ground fabric, at the lower weft insertion level.

The first (2) and the second effect weft threads (3) are thus inserted in each ground fabric (I),(II) during successive weft insertion cycles, and always in the same order.

Pile is formed on the ground weft threads (1) of the first, second and third series of two weft insertion cycles (the order of the series starts from the left in FIG. 2). As is the case with the fabric from FIG. 1, the ground weft threads (1) run on the back of the ground fabrics. Pile is formed on the ground weft threads (1) of the first and the second series by a first pile warp thread (21). On the ground weft thread (1) of the third series, pile is formed once (I) by a second pile warp thread (19) which is then immediately bound in in the lower ground fabric.

When they do not form pile, all pile warp threads (12)-(21) are bound in in the upper or the lower ground fabric as dead pile warp threads. The dead pile warp threads extend between the first (2) and the second effect weft threads (3) of the successive series in the respective ground fabric (I),(II). Depending on the desired effect, the second effect weft threads (3) run on the pile side of the dead pile warp threads (12)-(21) and the first effect weft threads (2) run on the back of these dead pile warp threads, or vice versa.

In each ground fabric (I),(II), the tension warp threads (8),(9);(10),(11) extend between the two effect weft threads (2),(3), on the one hand, and the ground weft threads (1) of the successive series, on the other hand.

Alternatively, a part of the dead pile warp threads may be bound in at least partly in a non-covering manner and may thus extend between the ground weft threads (1) and the effect weft threads (2),(3), running along the tension warp threads (8),(9),(10),(11). This is an alternative for the methods from FIGS. 2 to 4 which is not shown.

The weft threads (1),(2),(3) are thus kept at three different binding levels by the tension warp threads (8),(9); (10),(11) and the dead pile warp threads (12)-(21) in both ground fabrics, namely a first binding level for the ground weft threads (1), on the back of the ground fabric, a second binding level for the covered effect weft threads (2),(3), between the tension warp threads (8),(9);(10),(11) and the covering dead pile warp threads (12)-(21), and a third binding level for the non-covered effect weft threads (2),(3), on the pile side of the pile fabric, with respect to the covering dead pile warp threads (12)-(21).

In the pile-free zone (from the fourth series), an effect is created by the first (2) and the second effect weft threads (3). By purposely positioning the covering dead pile warp threads, either the first effect weft thread (2) or the second effect weft thread (3) of these series is taken to the pile side of the covering dead pile warp threads (12)-(21), while the other effect weft thread is in each case taken to the back of these dead pile warp threads and is covered thereby. Thus, it is possible, depending on a predetermined effect, to make one or the other effect weft thread (2),(3) substantially visible, while substantially covering the other, as desired, by positioning the pile warp threads (12)-(21).

In FIG. 2, the second effect weft thread (3) of the seventh series is taken to the pile side in both ground fabrics (I),(II), so that it is substantially uncovered, while in the fourth, fifth, sixth and eighth series, it is in each case the first effect weft thread (2) which runs on the pile side. At the location of the seventh series weft threads (1),(2),(3), the colour of the second effect weft thread (3) will be substantially visible, while at the location of the other series of the pile-free zone this will in each case be the colour of the first effect weft thread (2). Thus, an additional colour variation becomes visible in the pile-free zone of both ground fabrics (I),(II).

In contrast to the method from FIG. 1, two binding warp threads (4),(4'),(5),(5'); (6),(6'); (7),(7') are provided per reed opening for each ground fabric. These binding warp threads have a weave repeat over eight weft insertion cycles (see FIG. 2). The binding warp threads of adjacent reed openings, shown in the upper and the lower cross section in FIG. 2, respectively, cooperate to bind in the weft threads (1),(2),(3).

The tension warp threads (9),(11) for the lower ground fabric (II) may be taken alternately below the lower weft insertion level and between the central and the lower weft insertion level. The tension warp threads (8),(10) for the upper ground fabric (I) may be taken alternately above the upper insertion level and between the upper and the central weft insertion level. This does not require any complicated drive.

A drive with cams for the weaving frame which positions the tension warp threads (8),(9);(10),(11) is then sufficient. A drive per weaving frame via dobby allows for slightly greater flexibility and it is even possible to adjust the movement per movement cycle in terms of position, speed and timing with respect to the other components of the weaving loom, using one servomotor per weaving frame.

Figure 3:
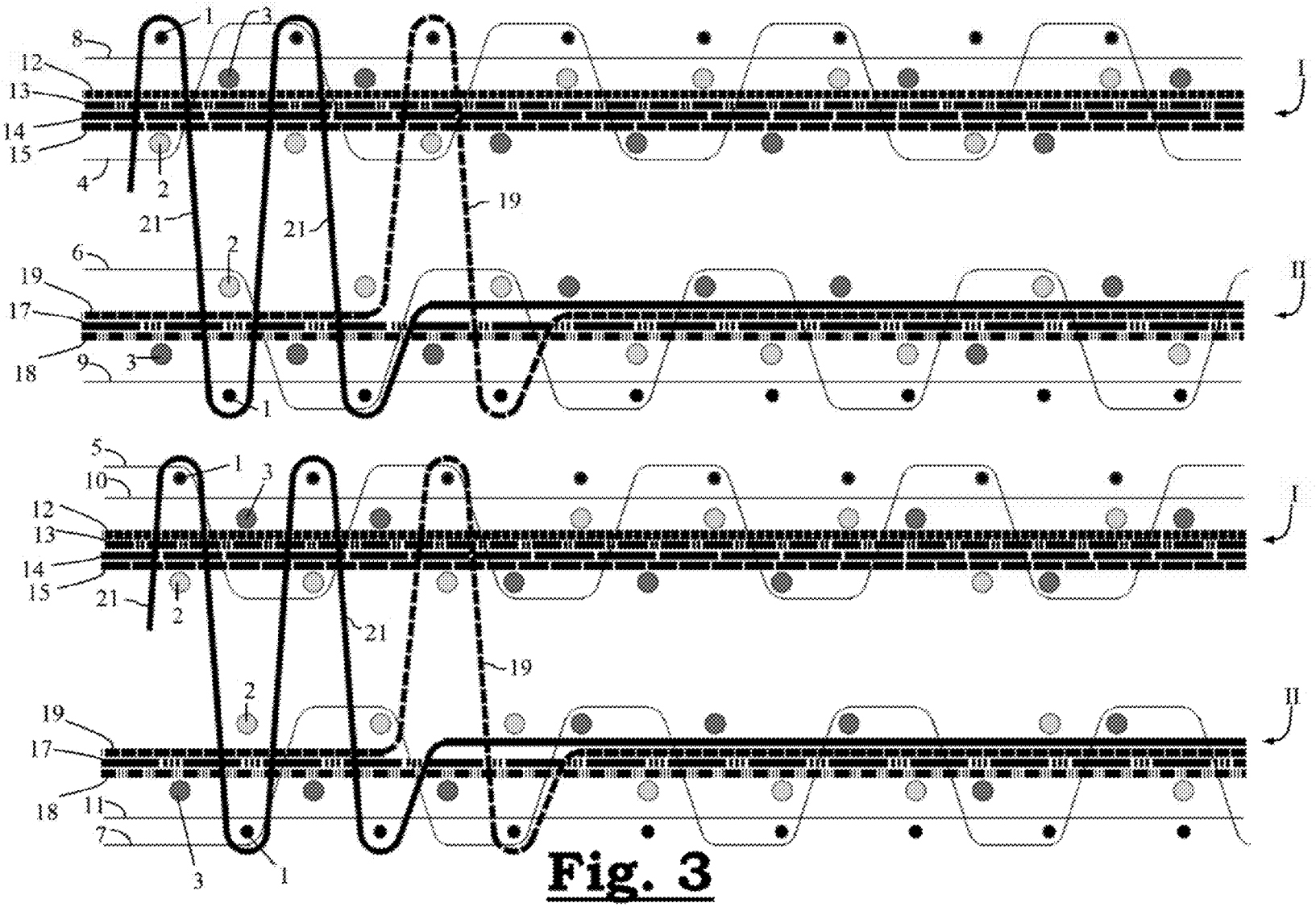
Figure 4:
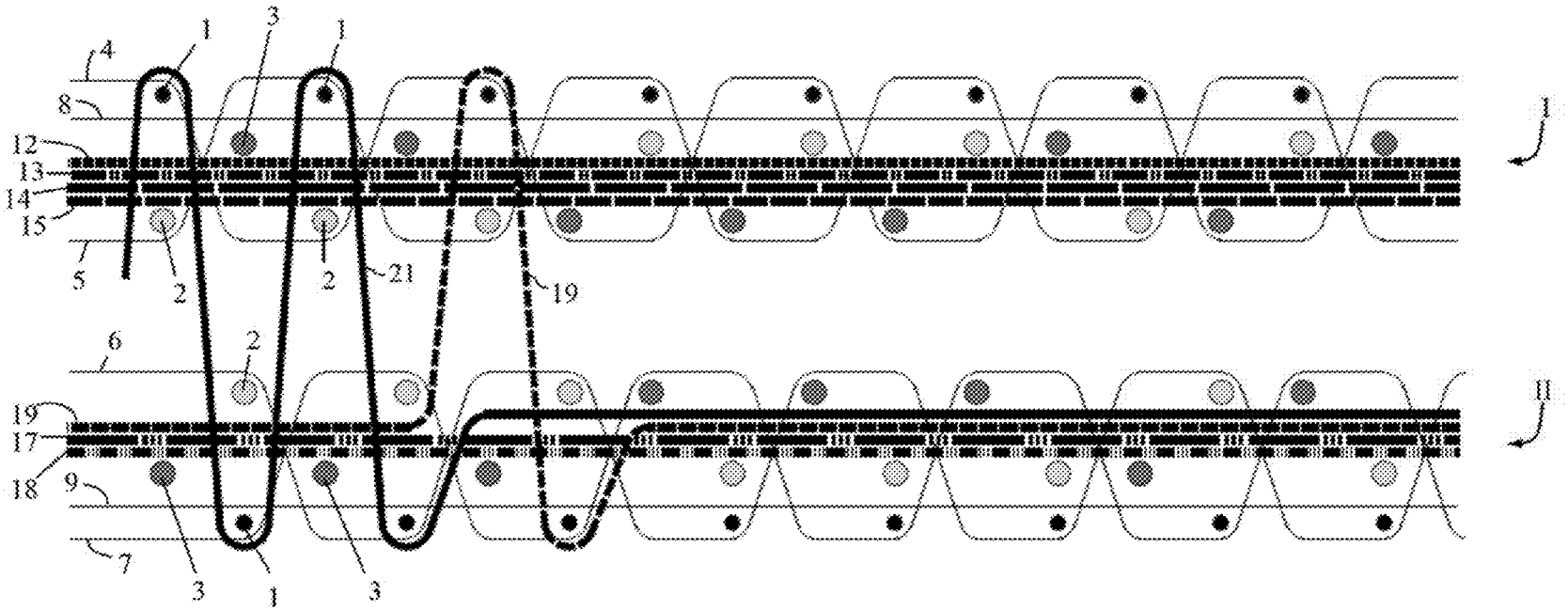

The methods from FIGS. 3 and 4 differ from the method from FIG. 2 only in that a simpler weave structure is used for the binding warp threads (4),(5);(6),(7). When the binding warp threads are not used for covering effect weft threads (1),(2),(3) in pile-free zones, a simple cam drive on weaving frames may also be sufficient for positioning the binding warp threads.

As is illustrated in FIGS. 3 and 4, the one binding warp thread (6),(7) of a set of cooperating binding warp threads for the lower ground fabric (II) may be moved, in which case it is positioned as follows during four successive weft insertion cycles:

- below the lower weft insertion level during the first and the second insertion cycle;
- between the lower and the central weft insertion level during the third insertion cycle; and
- between the central and the upper weft insertion level during the fourth insertion cycle.

The other binding warp thread (7),(6) of the set of cooperating binding warp threads, which is provided in the same reed opening in FIG. 4 and in an adjacent reed opening in FIG. 3, can then be positioned as follows during the same four weft insertion cycles:

- between the lower and the central weft insertion level during the first weft insertion cycle;

between the central and the upper weft insertion level during the second weft insertion cycle; and below the lower weft insertion level during the third and the fourth weft insertion cycle.

The weave structure for the binding warp threads in the upper ground fabric is similar: for the one binding warp thread of a set of cooperating binding warp threads, this is successively:

above the upper weft insertion level during the first insertion cycle;

between the upper and the central weft insertion level during the second insertion cycle;

between the central and the lower weft insertion level during the third insertion cycle, and above the upper weft insertion level during the fourth insertion cycle.

For the other binding warp thread of the set, this is successively:

between the central and the lower weft insertion level during the first insertion cycle;

above the upper weft insertion level during the second and the third insertion cycle; and between the upper and the central weft insertion level during the fourth insertion cycle.

It is possible to provide the two cooperating binding warp threads (4),(5);(6),(7) for each ground fabric (I),(II) in the same reed opening, as with the method from FIG. 4, but it is also possible for only one binding warp thread to be provided per ground fabric per reed opening and for the binding warp threads of adjacent reed openings to cooperate, as with the method from FIG. 3. The effect of this measure is that the weft threads which are to produce the effect are interlaced to a lesser degree in the pile-free zones by binding warp threads and are therefore more clearly visible.

According to the method described above with reference to FIG. 2, a 2/3V pile fabric is produced having pile-free zones in which an additional effect is created using two differently coloured effect weft threads (2),(3). To this end, two different types of weft yarn (weft yarn for the first effect weft thread and for the ground weft thread) have to be presented to the weft insertion means at the upper and the lower weft insertion level. At the central insertion level, weft yarn for a second effect weft thread has to be presented in each case. This requires a weft change motion which is capable of presenting two different types of weft yarn at two different levels.

This number is lower than for the method from FIG. 1 on the two-gripper weaving loom.

With this weave structure, pile is interlaced in each ground fabric over two weft threads per three weft threads, hence a 2/3 V pile weave. It is possible to increase this number of weft threads. If this is increased to four by in each case inserting a third effect weft thread in each fabric, series of three successive weft insertion cycles are obtained in which one ground weft thread (1) and three effect weft threads are inserted in the same order for each ground fabric. As a result thereof, the pile weave is a 2/4V pile weave. Each series of weft threads contains one ground weft thread (1) which runs on the back of the fabric with respect to the tension warp threads (7),(8); (9),(10) and three effect weft threads (2),(3) which run on the pile side.

In general, an increase to n weft threads per series and per ground fabric results in a 2/n V pile weave with one ground weft thread (1) on the back of the fabric and (n−1) effect weft threads (2),(3) on the pile side. The weft change motion therefore also has to be adapted to the number of effect weft threads and has to be designed to insert n−1 different weft threads at two different weft-insertion levels.

For the tension warp threads (9),(11) of the lower ground fabric (II), a weave pattern is for example provided in which the tension warp thread runs alternately above one weft thread and below (n−2) weft threads. The tension warp threads (8), (10) of the upper ground fabric (I) then run alternately above (n−2) weft threads and below one weft thread. This can still be achieved using a cam drive via weaving frames up to a 2/8V pile weave. If n is equal to or greater than 9, i.e. from a 2/9V pile weave, a longer weave repeat has to be accommodated for by a dobby drive or a servodrive for the weaving frame, optionally even a jacquard drive for each heddle or each group of heddles.

The binding warp threads (4),(5);(6),(7) of both ground fabrics is positioned according to a pattern, for example, by means of a repetitive less complex drive, in which they are successively taken, for the lower ground fabric:

below the lower weft insertion level during (n−1) weft insertion cycles, between the lower and the central weft insertion level during (n−2) weft insertion cycles, and between the central and the upper weft insertion level during one weft insertion cycle.

and for the upper ground fabric:

between the central and the lower weft insertion level during one weft insertion cycle, above the upper weft insertion level during (n−1) weft insertion cycles, between the upper and the central weft insertion level during (n−2) weft insertion cycles.

The cooperating binding warp thread is positioned according to a similar pattern, but this pattern is offset by (n−1) weft insertion cycles with respect to each other compared to the pattern of the other binding warp thread of the set. Two cooperating binding warp threads (4),(5);(6),(7) may be provided in the same reed opening or in adjacent reed openings.

This can still be achieved using a cam drive via weaving frames up to n=5, i.e. up to a 2/5V pile weave. If n is equal to or greater than 6, i.e. from a 2/6V pile weave, a longer weave repeat has to be accommodated for by a dobby drive or a servo-drive for the weaving frame, optionally even a jacquard drive for each heddle or each group of heddles.

If the number of binding warp threads (4),(5);(6),(7) for each reed opening and each ground fabric is greater than one and if these binding warp threads can be positioned separately, a modified standard weave can make the effect created in a pile-free zone by the effect weft threads more clearly visible by interlacing the effect weft threads in this zone to a lesser degree. A weave repeat over 8 weft insertion cycles, as illustrated in FIG. 2, is conceivable.

An increase in the number of weaving frames for controlling the binding warp threads, preferably in combination with dobby or servo control for each weaving frame, makes it possible to change the weave repeat quickly and to modify the interlacing effect.

A universal four-position jacquard device is required to position the pile warp threads (12-21). This means that each of the four possible positions, i.e. above the upper weft insertion level, between the upper and the central weft insertion level, between the central and the lower weft insertion level, and below the lower weft insertion level) has to be attainable in each weft insertion cycle.

Coverage by non-pile-forming pile warp threads within a certain zone can be achieved according to a 1/1 weave structure, a twill weave or a satin weave, for example a twill 4 or a satin 4, in, accordance with the desired effect. This is possible as the pile warp threads have to be positioned by means of a universal four-position jacquard device.

According to a highly preferred double-face weaving method using a three-gripper double-face weaving loom (which is not shown in the figures), it is possible to insert a ground weft thread and at least two effect weft threads having a different, a first and a second appearance-determining property (colour), respectively, in a first series of weft insertion cycles and insert a ground weft thread and at least two effect weft threads having a different, a third and a fourth appearance-determining property (colour), respectively, in a subsequent, second series of weft insertion cycles.

For each ground fabric, it is then possible to always insert alternately two weft threads and one weft thread, in which case therefore a ground weft thread is inserted every two weft insertion cycles. The effect weft threads are then inserted according to their desired order, always on the pile side of the pile fabric with respect to the tension warp threads.

The number of weft insertion cycles required to insert the four or more effect weft threads is then greater than the number of weft insertion cycles per ground weft thread (i.e. the number of insertion cycles after a ground weft thread has been inserted before the next ground weft thread is inserted). This makes it possible to provide more pile rows, so that the production rate does not drop excessively in the case of a pile fabric having many weft effects. In addition, this method makes it possible to weave pile fabrics with a finer pile design.

Thus, it is for example possible, to weave a pile fabric with four different effect weft threads and pile warp threads which are interlaced every two weft insertion cycles once so that they form pile at virtually the same production rate as a similar pile fabric with two different effect weft threads for each series of weft threads.

The method of the invention can also be used with the single-piece weaving of pile fabrics using the wire weaving technique, in which a loop is formed over an inserted metal wire, the rod, after which the loop, depending on the type of rod, remains a loop or is cut, resulting in cut pile, after the rod has been removed. Such pile fabrics are advantageously woven on a single-gripper weaving loom with wire mechanism, optionally driven by a servomotor.

The pile warp threads of the fabrics according to the figures are usually bound through. This means that the pile is formed over a weft thread which is situated on the back of the fabric. However, alternative methods according to the invention for pile fabrics with pile warp threads which are not bound through are also possible.

Figure 5:
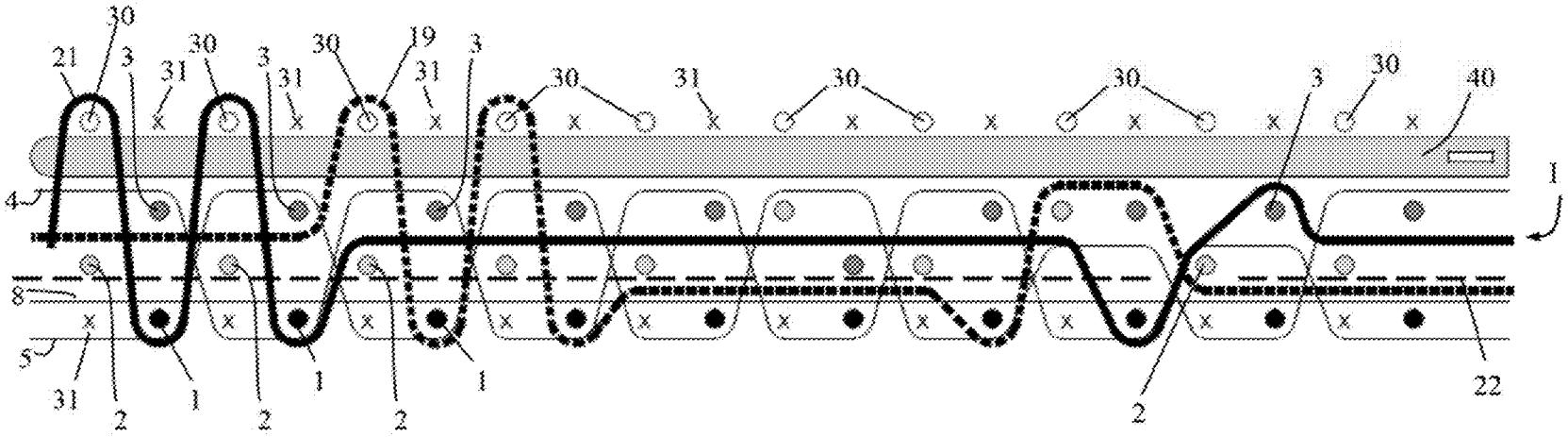
FIG. 5 shows a cross section of a single-face pile fabric which is woven on a three-gripper weaving loom, in which pile warp threads are alternately interlaced in the ground fabric and run over weft threads which are inserted above lancets while forming pile.

According to an advantageous method according to the invention, it is also possible to weave looped pile fabrics with zones containing looped pile and pile-free zones, both according to a double-face weaving method (see FIG. 6) and according to a single-piece weaving method (see FIG. 5). With both methods, a weaving loom with weft insertion means at three insertion levels (e.g. a three-gripper weaving loom) offers significant advantages.

According to a single-piece weaving method, a fabric with looped pile can be produced on a weaving loom which is designed to insert a respective weft thread (1),(2),(3) in the successive weft insertion cycles, in each case at three different weft-insertion levels, such as for example a three-gripper weaving loom comprising a gripper system at three levels for inserting weft threads.

The weaving loom is provided with lancets (40) which are situated between the upper and the central weft insertion means (see FIG. 5) viewed in the warp direction.

During series of two successive weft insertion cycles, the following steps are in each case carried out:

in the first weft insertion cycle:

- no weft thread is inserted by the lower weft insertion means (this insertion position is denoted in FIG. 5 by reference numeral (31))
- a first effect weft thread (2) is inserted by the central weft insertion means, and
- a loop weft thread (30) is inserted above the lancets (40) by the upper weft insertion means.

in the second weft insertion cycle:

- a ground weft thread (1) is inserted by the lower weft insertion means,
- a second effect weft thread (3) is inserted by the central weft insertion means, and
- no weft thread is inserted by the upper weft insertion means (this insertion position is denoted in FIG. 5 by reference numeral (31)) above the lancets (40).

Each series of weft threads consequently contains a first (1) and a second effect weft thread (3), inserted in successive weft insertion cycles, a ground weft thread (1), and a loop weft thread (30) which is inserted above the lancets (40).

A woven ground fabric (I) is produced by the inserted weft threads (1),(2),(3) being bound in by a set of two cooperating binding warp threads (4),(5) per reed opening. To this end, the cooperating binding warp threads (4),(5) are alternately taken above and below the effect weft threads (2),(3) and the ground weft thread (1) of a series in counterphase. The tension warp threads (8) are bound in between the ground weft threads (1), on the one hand, and the effect weft threads (2),(3), on the other hand, in which the ground weft threads (1) in each case run on the back of the tension warp threads (8).

In the first and the second series of two weft insertion cycles, a first pile warp thread (21) is positioned in such a manner with respect to the weft-insertion levels that this pile warp thread (21) alternately runs over a loop weft thread (30) and is interlaced over a ground weft thread (1) in the ground fabric (I). In the third and the fourth series of two weft insertion cycles, a second pile warp thread (19) is positioned in such a manner that this pile warp thread (19) alternately runs over a loop weft thread (30) and is interlaced over a ground weft thread (1) in the ground fabric (I). The loop weft threads (30) are subsequently removed, so that a pile fabric with pile loops is produced. When the pile warp threads (19),(21) do not form pile, they are bound in in the ground fabric.

By purposely positioning the non-pile-forming pile warp threads (19),(21), it is possible to take, if desired and depending on a desired effect in the pile-free zone, the first effect weft thread (2), or the second effect weft thread (3), or both effect weft threads (2),(3) to the pile side of the dead pile warp threads (19),(21), so that they are substantially uncovered by warp threads (4),(5),(19),(21) in the finished fabric. After all, only the relatively thin binding warp threads (4),(5) then run over these effect weft threads (2),(3). The effect of the effect weft threads can then be increased still further by not providing two cooperating binding warp threads in every reed dent, but to distribute these over two adjacent reed dents.

It can be seen in FIG. 5 that the first effect weft thread (2) of the sixth series runs substantially uncovered on the pile side, while the second effect weft thread (3) of this series is bound in substantially covered between at least 1 dead pile warp thread (21) and the tension warp threads (8). In the fifth and the seventh series, the reverse is the case: the second effect weft thread (3) of the fifth and the seventh series runs substantially uncovered on the pile side, while the first effect weft thread (2) of these series is bound in substantially covered between at least 1 dead pile warp thread (21) and the tension warp threads (8).

As in the two weft insertion cycles of a series, one ground weft thread (1) is in each case inserted together with the one effect weft thread (2),(3) in the one insertion cycle, and the other effect weft thread is inserted together with a loop weft thread (30) in the other insertion cycle, only two weft insertion means have to be used in each weft insertion cycle. Alternately, there is a cycle in which only the lower and the central weft insertion means are used, and a cycle in which only the central and the upper weft insertion means are used.

As a result thereof, the weft effects can be woven in a more productive way than on a single-piece-weaving loom with double gripper, and still at the same load as that of a two-gripper weaving loom, so that the number of weft insertion cycles per minute does not have to be decreased.

In this case as weft, a universal four-position jacquard device is required to control the pile warp threads. Weft selection is only required for the central weft insertion level and at the upper and the lower insertion level, it has to be possible to disengage the weft insertion means (e.g. gripper disengagement) during the weft insertion cycles in which no weft thread has to be inserted at these levels. As an alternative, it is possible to use the weft insertion means (e.g. the gripper is inserted), but not to present weft thread to the weft insertion means during these weft insertion cycles (see reference numeral 31 in FIG. 5), for example by means of suitable control of the weft scissors.

It is possible to produce an additional effect by binding in more effect weft threads per series in the ground fabric so that they are visible on the pile side (substantially uncovered) and by binding in different combinations of two or more effect weft threads in the same pile-free zone or in different pile-free zones so that they are visible on the pile side.

Another additional effect can be produced by covering the effect weft threads with a pile warp thread as desired at desired sites in the pile-free zones, so that an additional colour effect is produced. This covering can be carried out over one or more effect weft threads, so that a short or long so-called ground floating yarn (pile which bears against the ground fabric) is obtained.

Yet another added effect can be achieved (see the effect weft threads of the ninth series in FIG. 5) by covering at least one effect weft thread (2) with at least one chosen non-pile-forming pile warp thread (22), in which one other effect weft thread (3) per series (the effect weft thread of the ninth series in FIG. 5) is only covered very locally by another pile warp thread (21), so that it comes to lie at a level above the other effect weft thread (2) of this series. As a result thereof, the covering pile warp thread (21) runs over the two effect weft threads (2),(3) which are situated at different levels (one above the other), as a result of which a false bouclé effect is produced.

If it is desired that the binding warp threads in such zones should not be visible and if it has to be possible to freely determine the location of this zone, the binding warp threads (4),(5) have to be positioned by a jacquard device.

- jacquard with 2 positions which are attainable in each weft insertion cycle, in the case of a two-gripper weaving loom,
- jacquard with 3 positions which are attainable in each weft insertion cycle, in the case of a three-gripper weaving loom.

Figure 6:
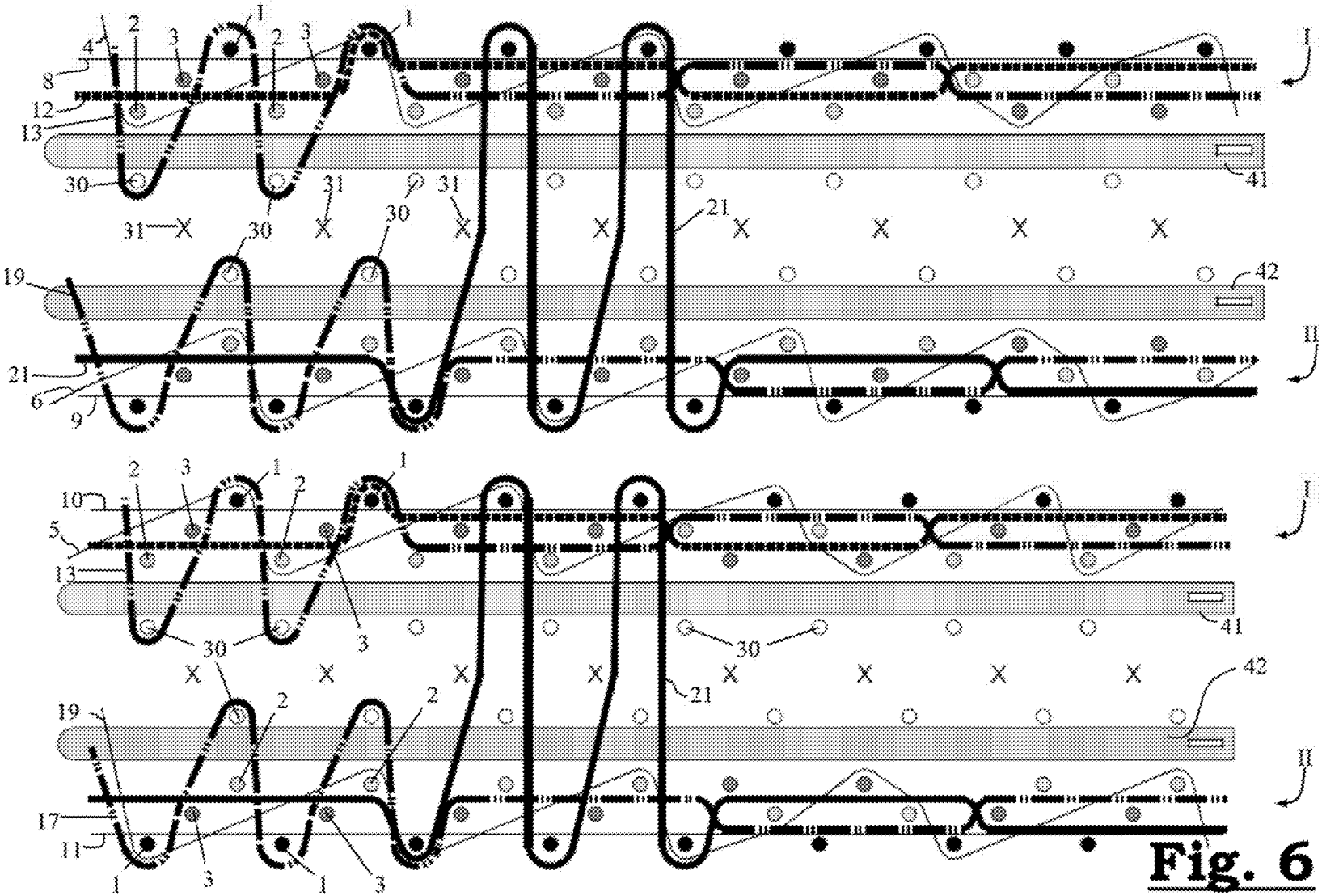
FIG. 6 shows two cross sections of a double-face pile fabric which is woven on a three-gripper weaving loom, in which pile warp threads are alternately interlaced in the ground fabric and run over weft threads which are inserted between upper and lower lancets while forming pile, and the pile warp threads also form pile as they are interlaced alternately in the upper and the lower ground fabric.

A fabric with weft effects in combination with looped pile and, if desired, also cut pile, can be produced on a double-face weaving loom with lancets, as is shown in FIG. 6.

The weaving loom is also designed to insert a respective weft thread (1),(2),(3) in the successive weft insertion cycles, in each case at three different weft-insertion levels, such as for example a three-gripper weaving loom with a gripper system on three levels for inserting weft threads.

The weaving loom is provided with a number of upper lancets (40) which extend between the upper and the central weft insertion level in the warp direction, and a number of lower lancets (41) which extend between the central and the lower weft insertion level in the warp direction.

During series of three successive weft insertion cycles, the following steps are in each case carried out:

in the first weft insertion cycle:
- a ground weft thread (1) is inserted below the lower lancets (41) by the lower weft insertion means,
- a loop weft thread (30) for forming pile loops on the upper ground fabric is inserted between the upper (40) and the lower lancets (41) by the central weft insertion means,
- a first effect weft thread (2) is inserted above the upper lancets (40) by the upper weft insertion means.

in the second weft insertion cycle:
- a second effect weft thread (3) is inserted below the lower lancets (41) by the lower weft insertion means,
- no loop weft thread is inserted between the upper (40) and the lower lancets (41) by the central weft insertion means. The insertion position where no weft thread is inserted is denoted by reference numeral 31.
- a second effect weft thread (3) is inserted above the upper lancets (40) by the upper weft insertion means.

in the third weft insertion cycle:
- a first effect weft thread (2) is inserted below the lower lancets (41) by the lower weft insertion means,
- a loop weft thread (30) for forming pile loops on the lower ground fabric is inserted between the upper (40) and the lower lancets (41) by the central weft insertion means,
- a ground weft thread (1) is inserted above the upper lancets (40) by the upper weft insertion means.

According to a double-face weaving method, two ground fabrics (I),(II) are woven one above the other while respective loop weft threads (30) are kept at a distance from the upper (I) and the lower ground fabric (II) by respective lancets (40), (41).

Two ground fabrics (I),(II) are woven, one above the other, by binding in the inserted weft threads (1),(2),(3) at an upper and a lower level by respective sets of two cooperating binding warp threads (4),(5);(6),(7). The cooperating binding warp threads (4),(5) are provided in adjacent reed openings and run alternately above and below the effect weft threads (2),(3) and the ground weft thread (1) of a series, in counter-phase with respect to each other.

In an alternative method (not shown), the cooperating binding warp threads may also be provided for each reed dent if they are sufficiently thin so as not to adversely affect the effect of the weft.

Each ground fabric also comprises tension warp threads (8),(10); (9),(11) which are bound in between the ground weft threads (1), on the one hand, and the effect weft threads (2),(3), on the other hand, with the ground weft threads (1) in each case running on the back of said tension warp threads (8),(10); (9),(11).

A first pile warp thread (13) is alternately interlaced in the upper ground fabric (I) over a ground weft thread (1) and taken below a loop weft thread (30). The loop weft threads (30) are subsequently removed so that pile loops are formed thereby on the upper ground fabric (I). A second pile warp thread (19) is alternately interlaced in the lower ground fabric (II) and taken above a loop weft thread (30), so that pile loops are formed on the lower ground fabric (II). These pile loops are formed over the loop weft threads (30) of the first and the second series of weft threads (1),(2),(3),(30), and these pile warp threads are bound in from the third series of weft threads.

The bound-in dead pile warp threads run alternately between the ground weft threads (1), on the one hand, and the two effect weft threads (2),(3) of two successive series, on the other hand, and between the first effect weft threads (2), on the one hand, and the second effect weft threads (3) of two successive series, on the other hand.

Depending on the desired effect, it is decided for each series whether the first (2) or the second effect weft thread (3) is taken to the pile side of the covering bound-in dead pile warp threads.

In the third and the fourth series of weft insertion cycles, a third pile warp thread (21) is positioned in such a manner with respect to the weft insertion levels, that it is alternately interlaced in the upper (I) and the lower ground fabric (II) over a ground weft thread (1). This pile warp thread (21) is subsequently cut between both ground fabrics, so that a zone with cut pile is also obtained on both fabrics. For the cut pile, a 1/3V pile weave or a general 1/n V pile weave can be used (if n weft threads are inserted per ground fabric per series). To this end, the pile warp threads have to be positioned by a universal four-position-jacquard device.

If no pile warp threads are interlaced alternately in the upper (I) and the lower ground fabric (II) over a ground weft thread (1), a universal three-position jacquard device is in principle sufficient and this makes it possible to produce two looped pile fabrics simultaneously by means of the double-face weaving process.

The central weft insertion means inserts loop weft threads (30) for both the upper ground fabric and the lower ground fabric between the upper (40) and the lower lancets (41) for forming loops. These loop weft threads are subsequently removed from the pile fabric, either manually or with the aid of a removal device provided for the purpose. The looped pile is interlaced in the ground fabric with a ground weft thread (1) which is situated on the back of the pile fabric with respect to the tension warp threads (8),(9),(10),(11).

The upper weft insertion means inserts the two effect weft threads (2),(3) for the upper ground fabric (I), in each series of weft insertion cycles or in the first and the second weft insertion cycle, respectively. The lower weft insertion means inserts the two effect weft threads (2),(3) for the lower ground fabric (II) in the second and the third weft insertion cycle, respectively. In the upper ground fabric (I), the first effect weft thread (2) is inserted first in each series, followed by the second effect weft thread (3). In the lower ground fabric (II), the second effect weft thread (3) is inserted first in each series, followed by the first effect weft thread (2).

The possibilities of creating additional effects by means of effect weft threads, associated covering dead pile warp threads and ground floating yams are the same as with the above-described double-face weaving methods using a double-gripper weaving loom, as described with reference to FIG. 1. Only the weft threads inserted by central weft insertion means are additional here in order to be able to guarantee loop formation. However, these additional weft threads do not produce an additional effect themselves, as they are subsequently removed.

Thus, analogous to the 1/3V pile weave for forming cut pile using two effect weft threads, it is for example possible to describe looped pile-weaving as a 1/3V looped pile with two effect weft threads. Both pile fabrics have a pile weave repeat and a weft repeat of three weft insertion cycles. Since only two weft threads are required at the central weft insertion level to form loops over in these three weft insertion cycles, the weft insertion means for the central insertion level does not have to insert weft thread in the shed during one of the three weft insertion cycles. 1/n V pile fabrics are also possible, as described above for the two-gripper double-face weaving method. For the binding warp threads, the same weave structures can be used as with the above-described two-gripper double-face weaving method. The means required to move the yarns are also identical. In order to insert the correct weft yarns, weft selectors for three yarn types (or 'n yarn types', if n weft threads are provided per series per ground fabric) are required in order to present the correct weft yarns to the weft insertion means for the upper and the lower weft insertion level. The weft insertion means for the central weft insertion level have to be disengageable (e.g. gripper disengagement) or there has to be a possibility not to present weft thread to the weft insertion means during these weft insertion cycles (see reference numeral 31 in FIG. 6), for example by means of suitable control of the weft scissors.

The fabrics which are manufactured in accordance with this method are so-called 'cut loop' fabrics or fabrics comprising both cut pile and looped pile, in combination with pile-free zones.

In a method (not illustrated), it is also possible to omit the lancets from the previous method and to produce fabrics with false bouclé (pile formation over the weft threads inserted by the central weft insertion means, which are not removed thereafter), optionally in combination with cut pile, in which effect weft threads provide additional effects in pile-free zones, as has been described above for the other types of fabrics.

For weaving the fabrics (I),(II) illustrated in FIGS. 7 to 10, use is preferably made of a weaving loom with three gripper devices which are designed to each insert, in successive weft insertion cycles and at a respective insertion level, a weft thread (1),(2),(3) in a shed between warp threads (4-13),(101-104). These insertion levels which are situated one above the other are referred to below as the upper, the lower and the central insertion level.

Figure 7:
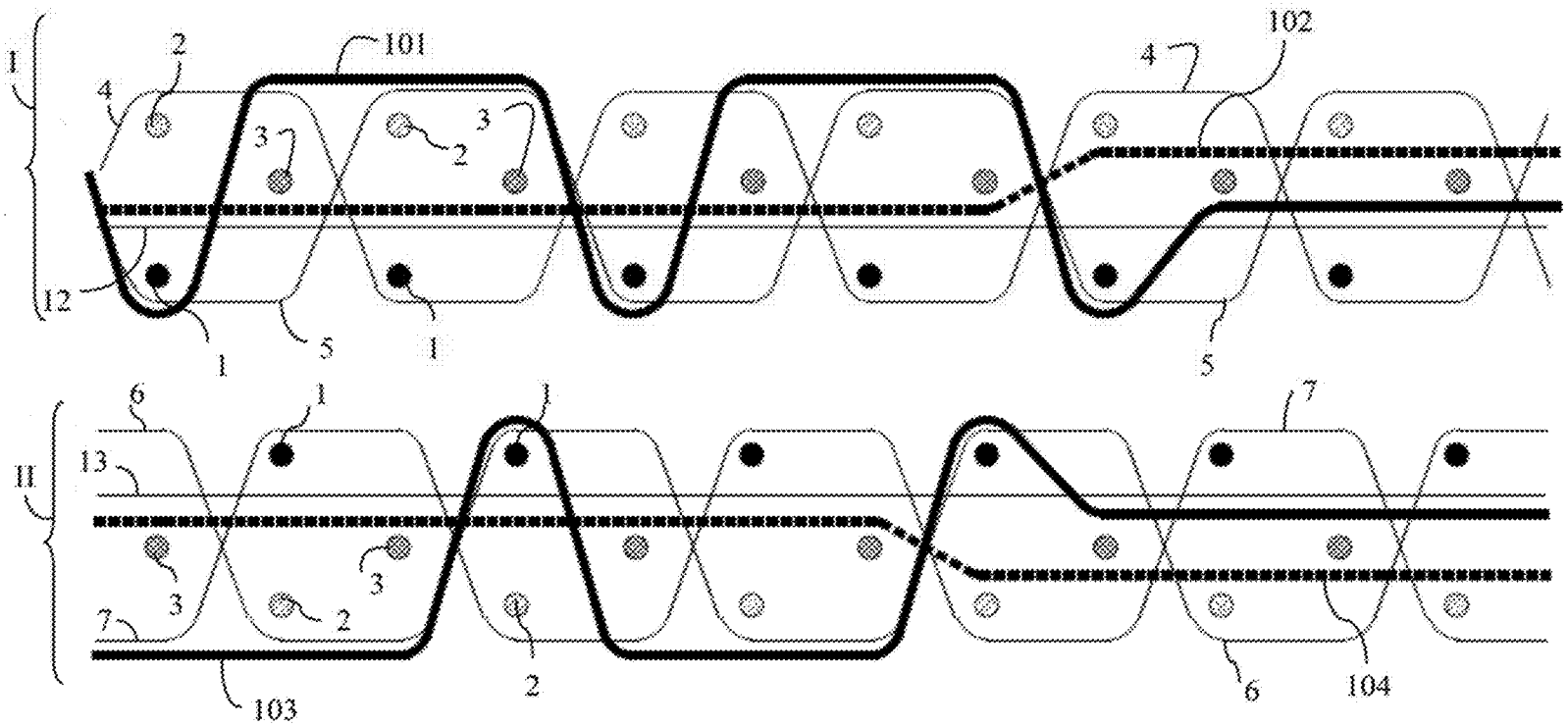
FIGS. 7, 8, 9 and 10 each show a cross section of two fabrics which are woven according to a double-face weaving method on a three-gripper weaving loom one above the other, in which warp threads are alternately interlaced in the ground fabric and run on the surface of the fabric so that they produce an effect on this surface and make the fabric locally thicker.

On the weaving loom, binding warp threads (4-11), effect warp threads (101-104) and tension warp threads (12),(13) are provided. In the successive weft insertion cycles, an effect weft thread (2),(3) is in each case inserted at the upper and the lower insertion level, while a ground weft thread (1) is in each case inserted at the central insertion level. During shed formation in each insertion cycle, said warp threads are in each case taken to such a position with respect to the three insertion levels, that an upper fabric (I) is woven having a figurative upper side in which effect warp threads (101),(102) and effect weft threads (2),(3) produce a predetermined effect, and simultaneously a lower fabric (II) is woven having a figurative lower side in which effect warp threads (103),(104) and effect weft threads (2),(3) produce a predetermined effect. Positioning the warp threads (4-13),(101-104) in order to achieve the desired fabric structures and the desired effect in the figurative sides is carried out, for example, by means of a known jacquard device. In the case of FIG. 7, this will be a full three-position jacquard machine for the effect warp threads and a two-position jacquard machine for the other warp threads.

The simple ground warp weave shown in FIG. 7 even allows the use of simpler means to carry out the movement of the warp threads which are not effect warp threads, for example via heddles on weaving frames which are driven by a cam mechanism, electronic dobby or via servomotors—optionally with associated reductors.

An effect weft thread (2) with a first colour and an effect weft thread (3) with a different second colour are alternately inserted in each fabric (I),(II). These differently coloured effect weft threads (2),(3) are subsequently referred to as first and second effect weft threads. Upon each insertion of three weft threads, a differently coloured effect weft thread (2),(3) is also inserted at the upper and the lower insertion level.

Figure 8:
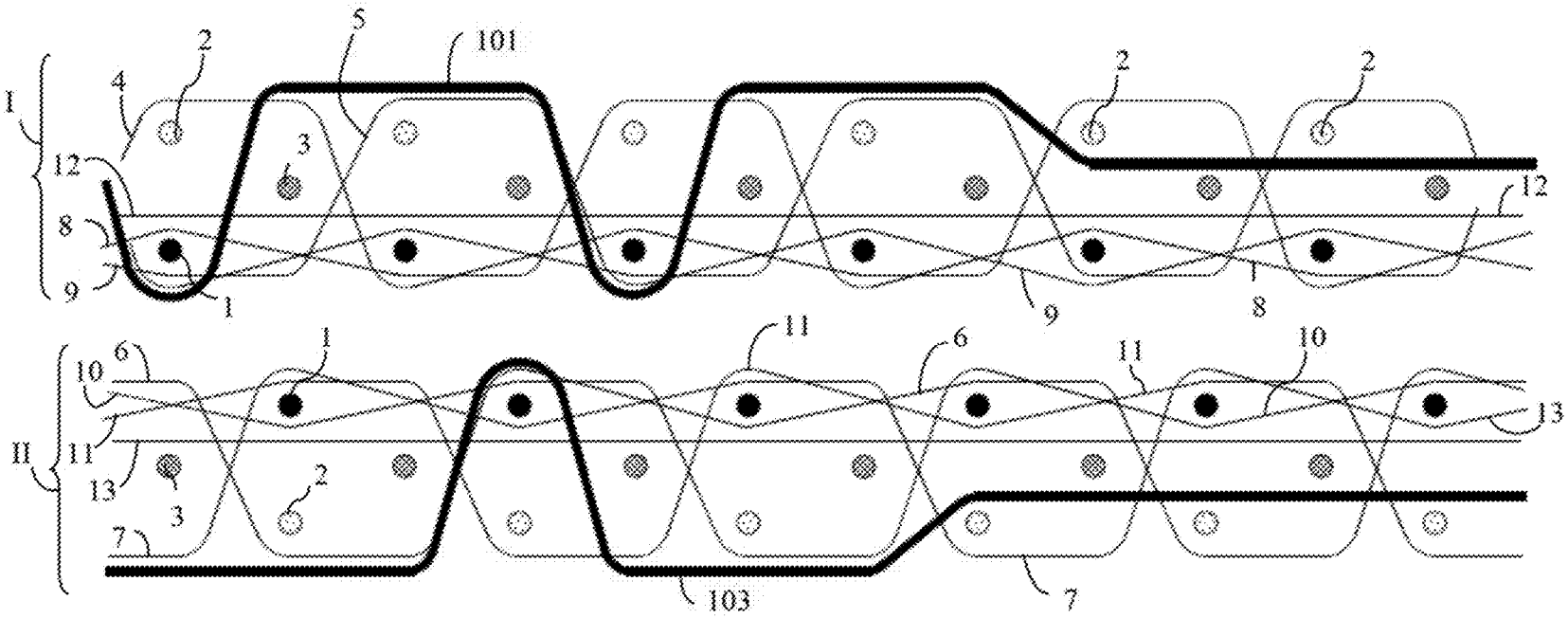
Figure 9:
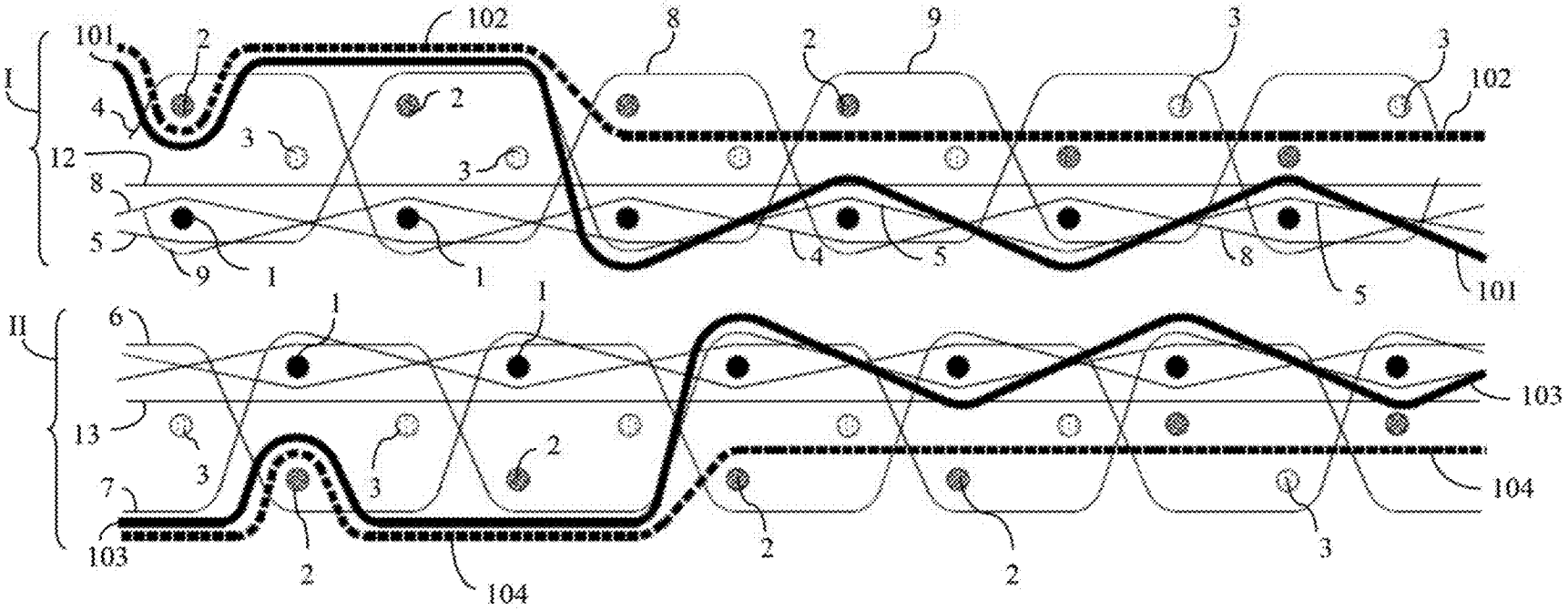

Thus, when weaving the fabrics (I),(II) illustrated in FIGS. 7 to 9, a first and a second weft insertion cycle are alternately used, in which

- in a first cycle, a first effect weft thread (2) is inserted at the upper insertion level, a ground weft thread (1) is inserted at the central insertion level, and a second effect weft thread (3) is inserted at the lower insertion level; and
- in a second cycle, a second effect weft thread (3) is inserted at the upper insertion level, a ground weft thread (1) is inserted at the central insertion level, and a first effect weft thread (2) is inserted at the lower insertion level.

This succession of first and second weft insertion cycles is continually repeated during the entire weaving process. In the present patent application, such a repetitive succession of two or more insertion cycles is referred to by the expression 'successive series of at least two successive weft insertion cycles'. This also results in a continually repeating alternation of first (2) and second effect weft threads (3) per fabric.

Figure 10:
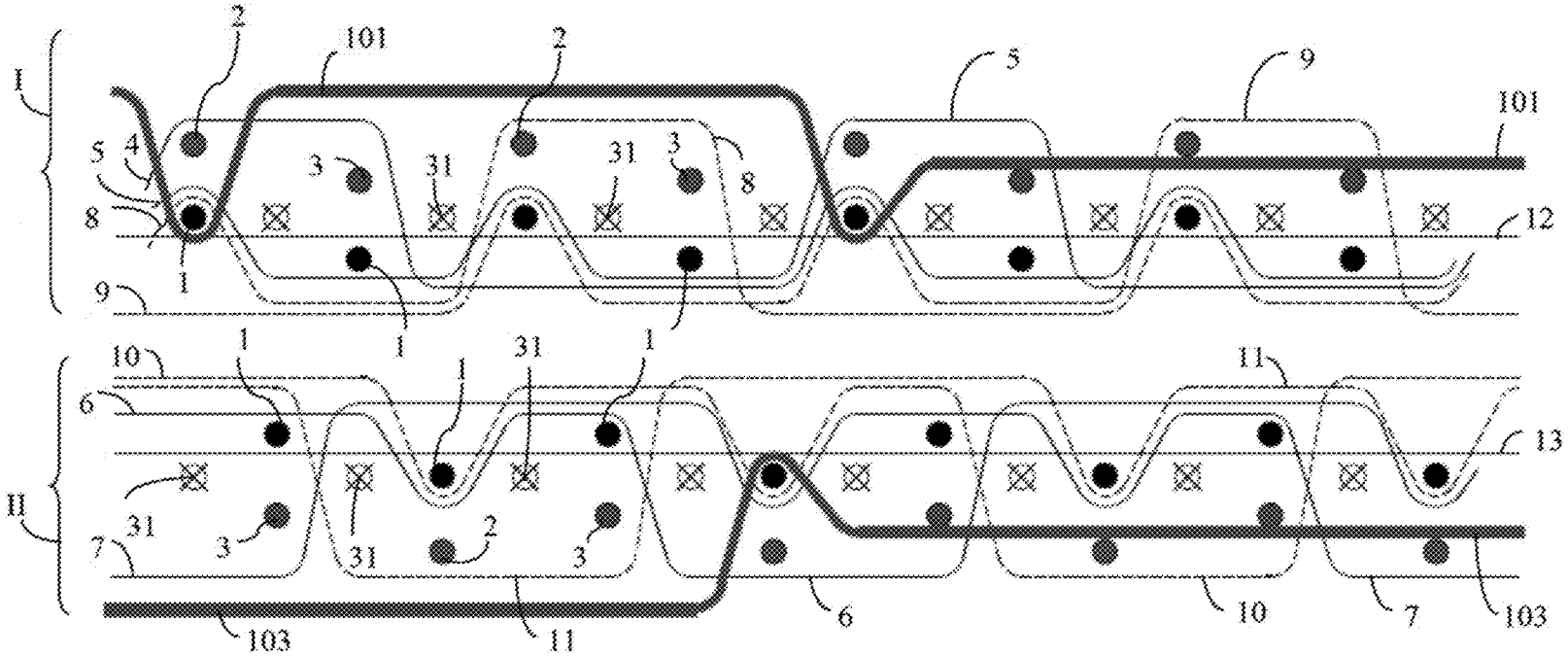

When weaving the fabrics illustrated in FIG. 10, use is also made of a three-gripper weaving loom according to the principle described above, but during the successive weft insertions, weft thread is alternately not inserted at the upper insertion level and at the lower insertion level. To this end, the upper and the lower grippers are alternately disengaged, for example, or weft thread is not presented to the gripper alternately at the upper and the lower insertion level. Thus, only two weft threads (1,2); (1,3) are inserted in each case. The location where a weft thread has been omitted in the fabric by disengaging insertion means or by not presenting a weft thread is designated by a crossed circle (31) in FIG. 10.

With the fabrics from FIG. 10, four weft insertion cycles take place successively, in which:

- in a first cycle, a first effect weft thread (2) is inserted at the upper insertion level and a ground weft thread (1) is inserted at the central insertion level;
- in a second cycle, a ground weft thread (1) is inserted at the central insertion level and a second effect weft thread (3) is inserted at the lower insertion level;
- in a third cycle, a second effect weft thread (3) is inserted at the upper insertion level and a ground weft thread (1) is inserted at the central insertion level; and
- in a fourth cycle, a ground weft thread (1) is inserted at the central insertion level and a first effect weft thread (2) is inserted at the lower insertion level.

As stated before, effect warp threads (101-104), binding warp threads (4-11) and tension warp threads (12),(13) are also provided for weaving these fabrics on the weaving loom. They are provided in several warp thread systems. On the diagrammatic cross section in the figures, the warp threads of one warp thread system are illustrated in each case.

The effect warp threads are positioned with respect to the three insertion levels by means of a jacquard machine during the successive insertion cycles. For each warp thread system, two effect warp threads (101),(102) of different colour are provided for the upper fabric (I) and two effect warp threads (103)(104) of different colour are provided for the lower fabric (II).

With the method illustrated in FIG. 7, the effect warp threads are positioned as follows: In the upper fabric (I), one of the effect warp threads (101) is positioned above the upper insertion level during the second, third and fourth insertion cycle, and during the sixth, seventh and eighth insertion cycle, so that there this effect warp thread (101) runs above the weft threads (2),(3) on the figurative upper side of the upper fabric (I) and creates a colour effect. At the same time, this effect warp thread (101) also covers the effect weft threads (2),(3) situated underneath so that these colours are less visible locally, or not at all, on the figurative upper side of this fabric (I).

In the lower fabric (II), a colour effect is likewise created by means of an effect warp thread (103) on the figurative lower side of the fabric (II). To this end, this effect warp thread (103) is positioned below the lower insertion level during the first, second and third insertion cycle, and during the fifth, sixth and seventh insertion cycle, so that there this effect warp thread (103) runs underneath the weft threads (2),(3) on the figurative lower side of the lower fabric (II) and creates a colour effect. At the same time, this effect warp thread (103) also covers the effect weft threads (2),(3) situated above, so that these colours are less visible locally, or not at all, on the figurative lower side of this fabric (I).

These effect warp threads (101),(103) are interlaced over a ground weft thread (1) of the respective fabric between two sections running on the figurative sides. A part of this effect warp thread (101),(103) is bound in in the fabric, in the extended state running between the ground weft threads (1) and the effect weft threads (2),(3).

Both in the upper (I) and in the lower fabric (II), a second effect warp thread (102),(104) is bound in in the fabric. In this case, in each fabric a left-hand part of this effect warp thread (102),(104) in the extended state between the ground weft threads (1) and the effect weft threads (2),(3), and a right-hand part alternately above and below the effect weft threads (2),(3) of the respective fabric. The left-hand part will be substantially invisible from the figurative side of the fabrics and contribute virtually nothing to achieving the desired effect, while the right-hand part does contribute to the effect as it locally covers the effect weft threads (2),(3) situated underneath (or above, in the case of the lower fabric).

With the fabric of FIG. 7, the first effect weft threads (2) are in each case taken to the figurative side of the second part of the bound-in effect warp thread (102),(104) so as to be visible, while the second effect weft threads (3) are covered thereby. It goes without saying that, by positioning this warp thread (102),(104) differently, it is possible to take the second effect weft threads (3) to the figurative sides and to cover the first effect weft threads (2) in each case, in order to thus make another colour visible on the figurative side of the fabrics.

According to the invention, the effect weft threads (2),(3) of each fabric (I),(II) are inserted at the same insertion level for each fabric. However, in the figures, these effect weft threads are shown at different levels in order to make it clear that when one effect weft thread is covered, the other effect weft thread on the upper side of the fabric becomes visible. In order to be able to cover certain effect weft threads and to make other effect weft threads visible, the effect warp threads do have to be positioned alternately above and below the insertion level of the respective effect weft threads. Therefore, although the effect warp threads (101-104) have been shown as being in the extended state in the zones where effect weft threads are visible on the figurative side, a movement is still required to position these effect warp threads (101-104) in those zones in the successive insertion cycles.

The fabrics from FIGS. 8 and 9 differ from the fabric in FIG. 7 by the fact that an additional set of binding warp threads (8),(9);(10),(11) was added in each fabric (I),(II). As a result thereof, it is not only possible to enclose the weft threads of each series by binding warp threads in accordance with FIG. 7, but also to additionally enclose only the ground weft threads (1). In this case, two binding warp threads are inserted alternately above and below the successive ground weft threads (1) of the respective fabric (I),(II), in counter-phase with respect to each other.

In this case, binding warp threads in the one zone of the fabric are used to bind in the weft threads per series (as shown in FIG. 7), and in another zone to bind in the successive ground weft threads (1), and vice versa.

As illustrated in FIG. 9, two effect warp threads (101), (102); (103),(104) can simultaneously run on the figurative side of the fabrics (I),(II) at the same location in the fabrics (I),(II). With the method according to said FIG. 9, the non-effect-producing parts of the effect warp threads (101),(103), running alternately above and below the ground weft threads (1), are bound in in the fabrics (I),(II).

In this way, the other effect warp thread (101),(103) does not impede the one effect warp thread (102),(104) when it covers the effect weft thread.

FIG. 9 also clearly shows how a transition is achieved in both fabrics (I),(II) from a binding in which in each case the first effect weft thread (2) runs on the figurative side of the fabrics (I),(II) to a binding in which the second effect weft thread (3) runs on the figurative side.

In the upper fabric (I), the first effect weft thread (2) which is inserted at the fifth and the seventh insertion cycle (counting from the left) runs above the bound-in effect warp thread (102), and the second effect weft thread (3) is in each case covered by this effect warp thread (102). Due to its covering function, this effect warp thread (102) is effect-forming, but not appearance-determining.

In the lower fabric (II), it is the first effect weft thread (2) of the sixth and the eighth insertion cycle which runs on the figurative side of the effect warp thread (104), while the second effect weft thread (3) is covered thereby. In the fabrics (I),(II), the effect at those locations is produced by the first effect weft thread (2).

Thereafter, a changeover takes place in which, in the tenth and twelfth insertion cycle in the upper fabric (I), and in the eleventh insertion cycle in the lower fabric (II), in each case the second effect weft thread (3) runs on the figurative side, while the first effect weft thread (2) is covered by the effect warp thread (102),(104). At those locations, the effect is thus produced by the second effect weft thread (3).

This changeover is achieved by correctly positioning the effect weft threads (102),(104) in the successive insertion cycles with respect to the insertion levels.

The invention claimed is:

1. Method for weaving a pile fabric with one or more pile-free zones, comprising:

inserting one or more ground weft threads between warp threads on a weaving loom in a series of successive weft insertion cycles, so that at least one ground fabric is woven comprising ground weft threads, binding warp threads and tension warp threads, and so that pile warp threads are interlaced, in at least one pile zone, with one or more ground weft threads in the ground fabric while forming pile;

inserting at least one ground weft thread and at least two effect weft threads having mutually different appearance-determining properties at well-defined weft insertion levels in successive series of at least two successive weft insertion cycles;

inserting the effect weft threads in each series in successive weft insertion cycles; and positioning, in order to create a predetermined effect in at least one pile-free zone, the warp threads in such a way with respect to the weft-insertion levels that, in at least one series, at least one effect weft thread runs substantially uncovered on the pile side of the ground fabric in at least a part of the pile-free zone.

2. Method for weaving a pile fabric according to claim 1, characterized in that insertion of the effect weft threads comprises inserting, during successive series of weft insertion cycles, in each case a first and a second effect weft thread, having a first and a second appearance-determining property, respectively.

3. Method for weaving a pile fabric according to claim 2, characterized in that the different first and second effect weft threads in each series are inserted in successive weft insertion cycles in the same order.

4. Method for weaving a pile fabric according to claim 1, characterized in that the positioning of the warp threads so that the effect is created comprises positioning the binding warp threads and/or the pile warp threads in such a way that, over several series, the one or more effect weft threads having the same appearance-determining properties run substantially uncovered on the pile side of the ground fabric in each case.

5. Method for weaving a pile fabric according to claim 1, characterized in that the positioning of the warp threads comprises positioning binding warp threads and/or the pile warp threads in such a manner that at least one effect weft thread of at least one series runs substantially uncovered on the pile side of the fabric in at least a part of the pile-free zone, while every other effect weft thread of this/these series in said part of the pile-free zone is substantially covered by binding warp threads and/or pile warp threads of the ground fabric.

6. Method for weaving a pile fabric according to claim 1, characterized in that the positioning of the warp threads comprises positioning the binding warp threads and/or the pile warp threads such that, in at least one series, a first effect weft thread runs substantially uncovered on the pile side of the ground fabric in a first part of a pile-free zone, and a second effect weft thread runs substantially uncovered on the pile side of the ground fabric in a second part of the same pile-free zone, so that a different effect is created in two parts of the same pile-free zone which succeed one another in the weft direction.

7. Method for weaving a pile fabric, according to claim 1, characterized in that the positioning of the warp threads comprises positioning the binding warp threads and/or the pile warp threads such that, in at least one series, a first effect weft thread runs substantially uncovered on the pile side of the ground fabric in a first pile-free zone, and a second effect weft thread runs substantially uncovered on the pile side of the ground fabric in a second pile-free zone, so that a different effect is created in two pile-free zones which succeed one another in the weft direction and are separated from each other.

8. Method for weaving a pile fabric according to claim 1, characterized in that positioning of the warp threads comprises positioning the pile warp threads in a pile-free zone such that at least one effect weft thread of at least one series runs substantially uncovered by pile warp threads on the pile side of the ground fabric, while every other effect weft thread of this/these series in said part of the pile-free zone is substantially covered by one or more pile warp threads of the ground fabric.

9. Method for weaving a pile fabric according to claim 1, characterized in that the positioning of the warp threads comprises positioning the pile warp threads in a pile-free zone such that one or more pile warp threads are not used for covering one or more effect weft threads and are bound in as dead pile warp threads in the ground fabric.

10. Method for weaving a pile fabric according to claim 1, characterized in that the positioning of the warp threads comprises positioning the binding warp threads in a pile-free zone such that at least one effect weft thread of at least one series runs substantially uncovered by binding warp threads on the pile side of the ground fabric, while every other effect weft thread of this/these series in said part of the pile-free zone is substantially covered by one or more binding warp threads of the ground fabric.

11. Method for weaving a pile fabric with one or more pile-free zones according to claim 1, characterized in that inserting one or more ground weft threads between warp threads on a weaving loom comprises inserting on a weaving loom having at least three different weft-insertion levels, in successive weft insertion cycles, in each case an upper effect weft thread at an upper insertion level, and/or a lower effect weft thread at a lower insertion level, and a ground weft thread at an intermediate insertion level, between warp threads, wherein the positioning of the warp threads comprises positioning the warp threads with respect to the insertion levels in such a way that:

the upper effect weft threads in each case form part of the upper fabric, the lower effect weft threads in each case form part of the lower fabric, and the ground weft threads alternately form part of the upper and the lower fabric, in the upper fabric, at least one upper effect weft thread runs substantially uncovered for a predetermined length on the upper side of the fabric, so that a figurative side with a predetermined effect is produced on the upper side of said fabric, and in the lower fabric, at least one lower effect weft thread runs substantially uncovered for a predetermined length on the lower side of the fabric, so that a figurative side with a predetermined effect is produced on the lower side of said fabric.

12. Method for simultaneously weaving two fabrics according to claim 11, characterized in that effect warp threads are provided and wherein the positioning of the warp threads comprises positioning the effect warp threads such that, in at least one of the fabrics, one or more of said effect warp threads run on the figurative side of one or more effect weft threads and locally cover said effect weft threads, depending on the effect to be created.

13. Method for simultaneously weaving two fabrics according to claim 11, characterized in that effect warp threads are provided and wherein the positioning of the warp threads comprises positioning the effect warp threads such that, in at least one of the fabrics, one or more of said effect warp threads alternately run on the figurative side of the fabric and are interlaced with one or more weft threads of the fabric, so that their appearance-determining properties contribute to creating the desired effect.

14. Method for weaving a pile fabric according to claim 12, further comprising binding in non-effect-producing parts of effect warp threads in the upper and/or the lower fabric, running in the extended state between the ground weft threads, on the one hand, and the effect weft threads, on the other hand, or running alternately below and above the successive ground weft threads.

15. Method for simultaneously weaving two fabrics according to claim 12, further comprising binding in parts of effect warp threads in the upper and/or the lower fabric, running alternately above and below the successive effect weft threads.

16. Method for weaving a pile fabric according to claim 1, further comprising, according to a double-face weaving method, weaving two ground fabrics one above the other, interlacing one or more pile warp threads alternately in the upper and the lower ground fabric with a ground weft thread and cutting between both ground fabrics, so that two pile fabrics are formed.

17. Method for weaving a pile fabric according to claim 16, characterized in that the positioning of the warp threads comprises positioning the pile warp threads such that one or more pile warp threads form pile according to a 1/n V pile weave, in which n equals the number of weft threads which is inserted in every ground fabric in each series.

18. Method for weaving a pile fabric according to claim 16, characterized in that each series comprises three weft insertion cycles, and further comprising, during each series, inserting a ground weft thread, a first effect weft thread with a first appearance-determining property, and a second effect weft thread with a second appearance-determining property at two different weft-insertion levels.

19. Method for weaving a pile fabric according to claim 18, characterized in that, for each series of three weft insertion cycles, the insertion of the ground effect threat, first effect weft thread, and second effect weft thread at two different weft-insertion levels comprises:

in the first weft insertion cycle, in each case inserting a first effect weft thread at one weft insertion level and a ground weft thread at the other weft insertion level, in the second weft insertion cycle, in each case inserting a second effect weft thread at one weft insertion level, and a first effect weft thread at the lower weft insertion level, and in the third weft insertion cycle, in each case inserting a ground weft thread at one weft insertion level and a second effect weft thread at the other weft insertion level.

20. Method for weaving a pile fabric according to claim 16, characterized in that positioning the pile warp threads comprises positioning the pile warp threads by means of a three-position jacquard device by means of which every position in every weft insertion cycle is attainable.

21. Method for weaving a pile fabric according to claim 1, characterized in that weft threads are inserted at at least three different weft-insertion levels.

22. Method for weaving a pile fabric according to claim 21, characterized in that each series comprises two weft insertion cycles, and in that inserting the ground weft threads and effect weft threads comprises in each series, at the upper level inserting a ground weft thread and a first effect weft thread with a first appearance-determining property, at the central level in each case inserting a second effect weft thread with a second appearance-determining property, and at the lower level inserting a first effect weft thread and a ground weft thread.

23. Method for weaving a pile fabric according to claim 22, characterized in that positioning the warp threads comprises positioning the pile warp threads such that one or more pile warp threads form pile according to a 2/n V pile weave, in which n equals the number of weft threads which is inserted in each ground fabric for each series.

24. Method for weaving a pile fabric according to claim 21, characterized in that positioning of the warp threads comprises positioning the pile warp threads by means of a four-position-jacquard device by means of which every position in every weft insertion cycle is attainable.

25. Method for weaving a pile fabric according to claim 1, characterized in that the pile-forming pile warp threads are interlaced in every ground fabric with one or more ground weft threads which run along the back with respect to the tension warp threads of the respective ground fabric.

26. Method for weaving a pile fabric according to claim 1, characterized in that the weaving loom comprises a reed with several reed openings, in that the warp threads on the weaving loom are distributed over a number of reed openings, in which only one binding warp thread is provided for each reed opening per ground fabric, and in that positioning the warp threads comprises positioning the binding warp threads such that several sets of two cooperating binding warp threads are taken alternately above and below at least one weft thread, running in counterphase with respect to each other, and in that the two cooperating binding warp threads of a set belong to two adjacent reed openings, respectively.

27. Method for weaving a pile fabric according to claim 1, further comprising weaving at least one ground fabric while loop weft threads are kept at a distance from the ground fabric, and alternately interlacing one or more pile warp threads with a ground weft thread in the ground fabric and running them over at least one loop weft thread so that pile is formed, thus producing a pile fabric with pile loops.

28. Method for weaving a pile fabric according to claim 1, further comprising, according to a double-face weaving method, weaving two ground fabrics one above the other while respective loop weft threads are kept at a distance from the ground fabrics, and alternately interlacing one or more first pile warp threads in the upper ground fabric and running them over at least one loop weft thread, so that pile loops are formed on the upper ground fabric (I), and alternately interlacing one or more second pile warp threads are in the lower ground fabric and running them over at least one loop weft thread, so that pile loops are formed on the lower ground fabric.

29. Method for weaving a pile fabric according to claim 1, further comprising, according to a double-face weaving method, weaving two ground fabrics, one above the other, while respective loop weft threads are kept at a distance from the ground fabrics, alternately interlacing one or more first pile warp threads in the upper ground fabric and running them over at least one loop weft thread, so that pile loops are formed on the upper ground fabric, alternately interlacing one or more second pile warp threads in the lower ground fabric and running them over at least one loop weft thread, so that pile loops are formed on the lower ground fabric, and alternately interlacing one or more third pile warp threads in the upper and the lower ground fabric with a ground weft thread and cutting the one or more third pile warp threads between both ground fabrics, so that a zone of cut pile is also produced on both ground fabrics.

30. Method for weaving a pile fabric according to claim 1, characterized in that the different effect weft threads differ from each other by one or more of the following appearance-determining properties: colour, hairiness, lustre, coarseness, yarn material, thickness.

* * * * *